US012344437B1

(12) United States Patent
Margolis et al.

(10) Patent No.: US 12,344,437 B1
(45) Date of Patent: Jul. 1, 2025

(54) OPTIMIZED VENUE STORAGE APPARATUS

(71) Applicants: Scott Margolis, Arvada, CO (US); Seth Margolis, Arvada, CO (US); Michael Margolis, Chicago, IL (US); Abrianna Margolis, Tierra Verde, FL (US); Michele Margolis, Arvada, CO (US)

(72) Inventors: Scott Margolis, Arvada, CO (US); Seth Margolis, Arvada, CO (US); Michael Margolis, Chicago, IL (US); Abrianna Margolis, Tierra Verde, FL (US); Michele Margolis, Arvada, CO (US)

( * ) Notice: Subject to any disclaimer, the term of this patent is extended or adjusted under 35 U.S.C. 154(b) by 0 days.

(21) Appl. No.: 18/653,111

(22) Filed: May 2, 2024

(51) Int. Cl.
*B65D 25/22* (2006.01)
*B65D 81/26* (2006.01)

(52) U.S. Cl.
CPC ..... *B65D 25/22* (2013.01); *B65D 81/261* (2013.01)

(58) Field of Classification Search
CPC ... A45F 2200/0583; A47C 7/62; A47C 7/622; A47C 7/624; A47C 7/68; A47C 7/70; A47C 7/705; A47C 7/723; B65D 25/22; B65D 81/261
See application file for complete search history.

(56) References Cited

U.S. PATENT DOCUMENTS

| | | | | |
|---|---|---|---|---|
| 6,186,382 | B1 | 2/2001 | Bergin et al. | |
| 7,290,746 | B1 * | 11/2007 | Macias | A47C 7/705 248/314 |
| 9,730,518 | B1 | 8/2017 | Jacobs et al. | |
| 11,357,119 | B1 | 6/2022 | Seidl | |
| 2019/0014935 | A1 * | 1/2019 | Bergin | A47G 23/02 |

* cited by examiner

*Primary Examiner* — Andrew T Kirsch
(74) *Attorney, Agent, or Firm* — Owen G. Behrens; Smith & Hopen, P.A.

(57) ABSTRACT

Described herein relates to an apparatus for optimized retention and/or storage of a drink, foodstuffs, and/or merchandise configured to be removably and/or permanently coupled to a venue seat and methods thereof. The apparatus may be configured to be removably coupled to at least one portion of a venue seat (e.g., an armrest). The apparatus may include a generally cylindrical sidewall having a central axis. The apparatus may also comprise at least two appendages comprising at least one receptacle having a pair of sidewalls, a front wall, an end wall, a bottom wall, and/or a top end. As such, the at least one receptacle may be configured to retain foodstuffs and/or merchandise. Additionally, the apparatus may comprise at least one hooking mechanism disposed about at least one portion of the at least two appendages, such that a patron may dispose a sack, a bag, and/or apparel about the hooking mechanism.

18 Claims, 21 Drawing Sheets

OPTIMIZED VENUE STORAGE APPARATUS

BACKGROUND OF THE INVENTION

1. Field of the Invention

This invention relates, generally, to containers. Specifically, the present disclosure relates to an apparatus for optimized retention and/or storage of a drink (e.g., a cup), foodstuffs, paper items, writing utensils and/or mobile computing device styli, merchandise, and/or any additional personal property of a patron configured to be removably coupled to a venue seat (e.g., a theater and/or an arena) and methods thereof.

2. Brief Description of the Prior Art

When attending a sporting event, a concert venue, a movie theatre, and/or any alternative entertainment venue, drinks, foodstuffs, and/or merchandise are often purchased by the patron or otherwise made available. Placement of these snack foods in a sack, a box, and/or other similar containers may be distracting and/or may also be inefficient or cumbersome, especially as patrons take the drink, foodstuffs, and/or merchandise back to their seats before and/or while watching the event and/or entertainment and/or event. As such, it is difficult to hold a drink and food items while sitting at such an event as there is no table provided at most seats, and patrons often need their hands free to clap, read programs and/or to engage in the consumption of the food and/or beverage items they have purchased. In addition, most seats don't have tables, therefore any tray and/or paperboard provided by a concession area containing the drink and/or foodstuffs must be balanced on a patron's lap. Patrons may need to temporarily place food items on the ground or floor at the seat, exposing the foodstuffs to unsanitary conditions or to be kicked or the foodstuffs to spill onto the ground. These paperboard trays are not very sturdy and activity such as moving or clapping can cause a cup to tip out of the holder or for the tray to fall off the patron's lap. Condiments may also end up soiling the patron's clothing. Furthermore, with respect to any merchandise purchased by the patron, the patron may be required to lay and/or position the merchandise onto the ground posing a potential tripping/safety hazard, potentially causing damage, as additional patrons may accidentally impact (e.g., step-on) the merchandise disposed on the ground. Those items on the ground may also pose an obstacle and/or tripping hazard in the event of an urgent egress for an emergency situation.

To help alleviate this problem with current trays, many venues have added rigid cup holders to the seats or at the end of armrests. Commonly, such rigid cup holders are located in the back of the row of seats in front and generally between the seats as the backs of the seats generally do not extend backward as far at the side ends. Alternately, cup holders have been added at the forward ends of the seat armrests and/or to the venue wall and/or divider immediately in front of the forward most wall of a section. While these cup holders have proven very beneficial for holding drinks at such venues as discussed above, they still do not help with holding other items the patron may have acquired at the venue or in their possession, such as mobile computing devices, prepackaged food and candy, printed programs, pens or pencils to write on scorecards, or foodstuffs and/or any purchased merchandise that must be held by the hand of the patrons, balanced on the laps thereof, and/or disposed upon the ground near and/or under the seat of the patron subject to damage and soiling.

In an attempt to address the above noted shortcomings of holding drinks and foodstuffs at public venues combined beverage and food trays have been developed and are known in the art which are designed to mount in cup holders at public venues. For example, one combined beverage and food tray known in the art discloses an assembly having a beverage holder compartment and provides one or more surfaces for food and beverage placement, writing etc. It is adapted for use in theaters, stadiums, convention halls and home entertainment centers. However, this design is not suitable for beverage holders mounted to the backs of the seats in the forward row, as would also be cost-prohibitive as a disposable item at concession stands. Additionally, this design fails to account for any merchandise and/or non-drink and/or foodstuff material which may be purchased by the patron as it still requires the patron to dispose it upon the ground and/or balance it within the patron's lap.

Additionally, as known in the art, a portable customizable swiveling concession tray may be removably securable to a pre-existing container holder such that the tray and/or container holder can swivel about the connection of the tray to the seat. The connection includes a customizable insert which can be of different heights depending upon the pre-existing holder. However, like the example disclosed above, this design is inefficient as the design is particularly designed for mounting to a holder in an armrest and would not be suitable for mounting to a holder in the back of the forward row of seats. Moreover, this design would also be cost-prohibitive as a disposable item for concession stands.

Accordingly, what is needed is an efficient, cost-effective, and easy-to-use apparatus for optimized retention and/or storage of a drink (e.g., a cup), mobile computing devices, writing instruments and/or styli, foodstuffs, and/or merchandise configured to be removably coupled to a venue seat. However, in view of the art considered as a whole at the time the present invention was made, it was not obvious to those of ordinary skill in the field of this invention how the shortcomings of the prior art could be overcome.

SUMMARY OF THE INVENTION

The long-standing but heretofore unfulfilled need, as stated above, is now met by a novel and non-obvious invention disclosed and claimed herein. In an aspect, the present disclosure pertains to an optimized venue storage apparatus configured to be coupled to at least one portion of a venue seat. In an embodiment, the apparatus may comprise the following: (a) a housing having a drink receptacle, the drink receptacle including a cylindrical sidewall having a vertically extending central axis, such that the housing may be configured to be mounted to at least one portion of the venue seat; and (b) at least two appendages comprising at least one receptacle, the at least one receptacle having a front wall, an end wall, a bottom wall, and/or a top end, such that the at least two appendages may extend outwardly from the housing at an angle of at most about 90° to the central axis of the sidewall of the drink receptacle. In this embodiment, at least one portion of at least two appendages may be affixed to at least one portion of an outer surface of the sidewall of the housing.

In some embodiments, the drink receptacle may comprise a plurality of openings disposed about at least a portion of the bottom surface of the drink receptacle. In this manner, the top surface of the sidewall of the drink receptacle may be beveled to facilitate entry of the drink into the drink receptacle. Additionally, in these other embodiments, the at least one receptacle of the at least two appendages may be configured to retain foodstuffs, mobile computing devices, writing utensils, and/or merchandise. Accordingly, the top end of the at least one receptacle of the at least two appendages may also be beveled to facilitate entry of the foodstuffs, mobile computing devices, merchandise, or both into the at least one receptacle. The foodstuffs, merchandise, or both may be selected from a group consisting of food, candy, mobile devices, pens, pencils, markers, apparel, magazines, programs, scorecards, pamphlets, and/or a combination of thereof.

In addition, in some embodiments, the at least two appendages may further comprise at least one hooking mechanism disposed about at least one portion of an outer surface of a sidewall of the at least two appendages, such that the at least one hooking mechanism may be configured to temporarily affix the merchandise and/or any additional personal property of the patron to the outer surface of the sidewall of at least one of the at least two appendages. In these other embodiments, at least one portion of the sidewall of the at least two appendages and/or at least one portion of the sidewall of the housing may comprise a display device (e.g. an LED video screen) communicatively coupled to at least one external computing device, such that the display device may be configured to present a plurality of advertisements and/or venue-related material.

In some embodiments, at least one portion of the sidewall of the housing may be configured to couple to at least one portion of the venue seat by a coupling mechanism selected from a group consisting of a screw-threaded engagement, a magnetic engagement, a bias pin, a friction fit, and/or a combination of thereof. In this manner, in these other embodiments, the housing may further comprise a locking member, the locking member having an engaged position in which the locking member immobilized the housing relative to at least one portion of the venue seat and/or a disengaged position in which the housing is removable from the at least one portion of the venue seat. Additionally, in some embodiments, subsequent to receiving a manually applicable directional pressure, at least one of the at least two appendages may rotationally translate about a 180° range of motion to the central axis of the cylindrical sidewall of the drink receptacle.

Moreover, another aspect of the present disclosure pertains to an optimized venue storage apparatus configured to be coupled to at least one portion of a venue seat. In an embodiment, the apparatus may comprise the following: (a) a housing having a drink receptacle, the drink receptacle including a cylindrical sidewall having a vertically extending central axis, such that the housing may be configured to be mounted to at least one portion of the venue seat; (b) at least two appendages comprising at least one receptacle, the at least one receptacle having a front wall, an end wall, a bottom wall, and a top end, the at least two appendages extending outwardly from the housing at an angle of at most about 90° to the central axis of the sidewall of the drink receptacle; (c) a locking member, the locking member having an engaged position in which the locking member immobilized the housing relative to the at least one portion of the venue seat and/or a disengaged position in which the drink receptacle is removable from the at least one portion of the venue seat; and (d) at least one hooking mechanism disposed about at least one portion of an outer surface of a sidewall of the at least two appendages, such that the at least one hooking mechanism is configured to temporarily affix the merchandise and/or any additional personal property of the patron to the outer surface of the sidewall of at least one of the at least two appendages. In this embodiment, at least one portion of at least two appendages may be affixed to at least one portion of an outer surface of the sidewall of the housing.

In some embodiments, the drink receptacle may comprise a plurality of openings disposed about at least a portion of a bottom surface of the drink receptacle and/or the sidewall of the drink receptacle. Additionally, the top surface of the sidewall of the drink receptacle may be beveled to facilitate entry of the drink into the drink receptacle. In these other embodiments, at least one portion of the sidewall of the housing may be configured to couple to at least one portion of the venue seat by a coupling mechanism selected from a group consisting of a screw-threaded engagement, a magnetic engagement, a bias pin, a friction fit, and/or a combination of thereof In some embodiments, at least one portion of the sidewall of the at least two appendages, and/or at least one portion of the sidewall of the drink receptacle may comprise a display device communicatively coupled to at least one external computing device, such that the display device may be configured to present a plurality of advertisements and/or venue-related messaging and/or material. In some embodiments, subsequent to receiving a manually applicable directional pressure, at least one of the at least two appendages may rotationally translate about a 180° range of motion to the central axis of the cylindrical sidewall of the drink receptacle.

Furthermore, an additional aspect of the present disclosure pertains to a method for mounting storage onto at least one portion of a venue seat. In an embodiment, the method may comprise the following steps: (a) providing an optimized venue storage apparatus, the optimized storage apparatus comprising: (i) a housing having a drink receptacle, the drink receptacle including a cylindrical sidewall having a vertically extending central axis, such that the housing may be configured to be mounted to at least one portion of the venue seat; and (ii) at least two appendages comprising at least one receptacle, the at least one receptacle having a front wall, an end wall, a bottom wall, and a top end, the at least two appendages extending outwardly from the housing at an angle of at most about 90° to the central axis of the sidewall of the drink receptacle; and (b) temporarily affixing, via a coupling mechanism, at least one portion of the sidewall of the housing to at least one portion of the venue seat. In this embodiment, at least one portion of at least two appendages may be affixed to at least one portion of an outer surface of the sidewall of the housing.

In some embodiments, the provided optimized storage apparatus may further comprise a locking member, the locking member having an engaged position in which the locking member immobilizes the drink receptacle relative to at least one portion of the venue seat and/or a disengaged position in which the drink receptacle is removable from the at least one portion of the venue seat. In these other embodiments, the at least two appendages of the provided optimized venue storage apparatus may also comprise at least one hooking mechanism disposed about at least one portion of an outer surface of a sidewall of the at least two appendages, such that the at least one hooking mechanism may be configured to temporarily affix the merchandise and/or any additional personal property of the patron to the outer surface of the sidewall of at least one of the at least two appendages.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not restrictive.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1:
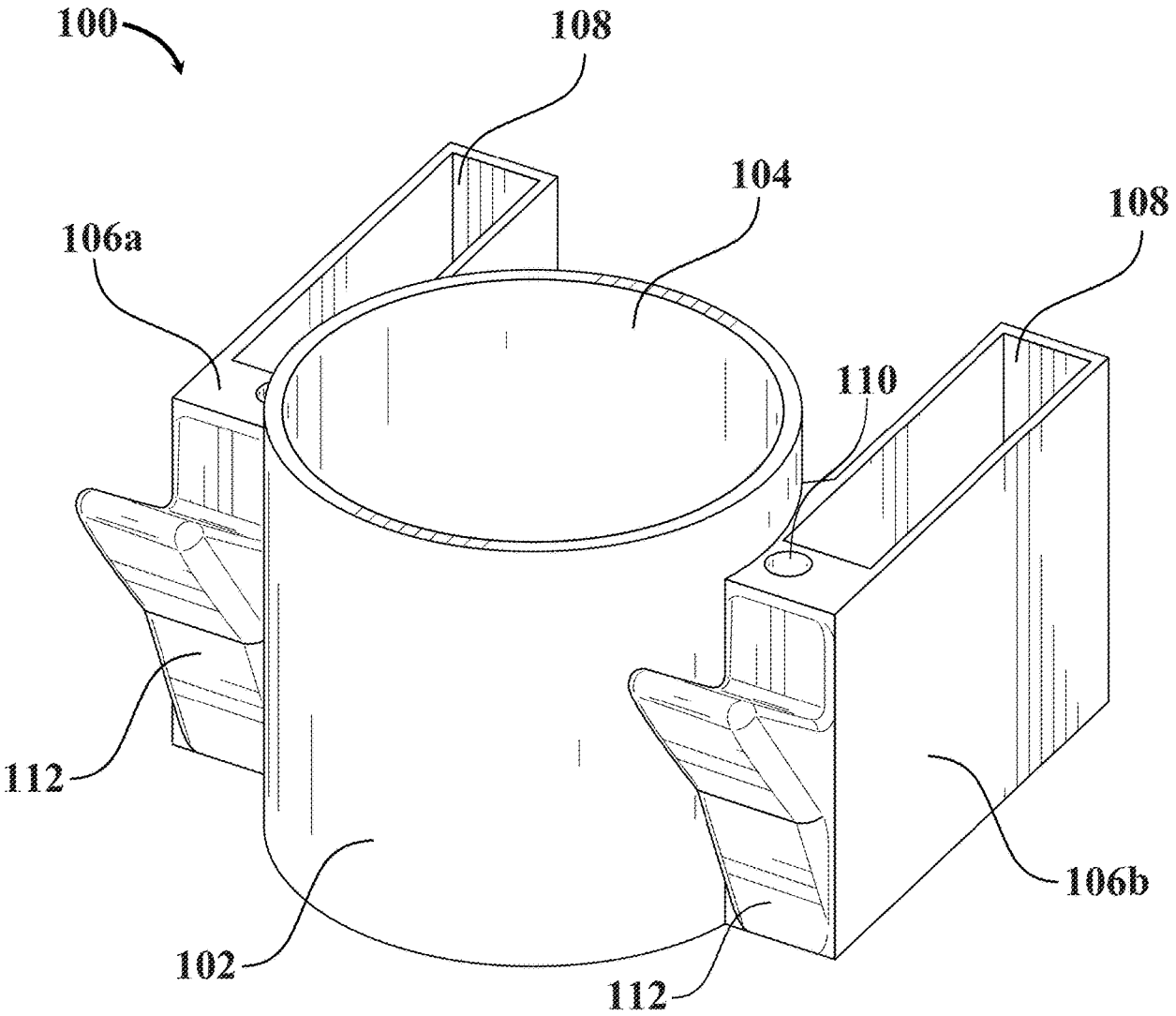
FIG. 1 is a front-perspective view of a first exemplary embodiment of a venue storage apparatus, according to an embodiment of the present disclosure.

In the following detailed description of the preferred embodiments, reference is made to the accompanying drawings, which form a part thereof, and within which are shown by way of illustration specific embodiments by which the invention may be practiced. It is to be understood that one skilled in the art will recognize that other embodiments may be utilized, and it will be apparent to one skilled in the art that structural changes may be made without departing from the scope of the invention.

As such, elements/components shown in diagrams are illustrative of exemplary embodiments of the disclosure and are meant to avoid obscuring the disclosure. Any heading(s) used herein, is (are) for organizational purposes only and shall not be used to limit the scope of the description or the claims.

Furthermore, the use of certain terms in various places in the specification, described herein, are for illustration and should not be construed as limiting. For example, any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Therefore, a reference to first and/or second elements does not mean that only two elements may be employed there or that the first element must precede the second element in some manner. Also, unless stated otherwise a set of elements may comprise one or more elements Reference in the specification to "one embodiment," "preferred embodiment," "an embodiment," or "embodiments" means that a particular feature, structure, characteristic, or function described in connection with the embodiment is included in at least one embodiment of the disclosure and may be in more than one embodiment. The appearances of the phrases "in one embodiment," "in an embodiment," "in embodiments," "in alternative embodiments," "in an alternative embodiment," or "in some embodiments" in various places in the specification are not necessarily all referring to the same embodiment or embodiments. The terms "include," "including," "comprise," and "comprising" shall be understood to be open terms and any lists that follow are examples and not meant to be limited to the listed items.

Referring in general to the following description and accompanying drawings, various embodiments of the present disclosure are illustrated to show its structure and method of operation. Common elements of the illustrated embodiments may be designated with similar reference numerals.

Accordingly, the relevant descriptions of such features apply equally to the features and related components among all the drawings. For example, any suitable combination of the features, and variations of the same, described with components illustrated in FIG. 1, can be employed with the components of FIG. 2, and vice versa. This pattern of disclosure applies equally to further embodiments depicted in subsequent figures and described hereinafter. It should be understood that the figures presented are not meant to be illustrative of actual views of any particular portion of the actual structure or method but are merely idealized representations employed to more clearly and fully depict the present invention defined by the claims below.

DEFINITIONS

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

In the following description, for the purposes of explanation, numerous specific details are set forth in order to provide a thorough understanding of embodiments of the present technology. It will be apparent, however, to one skilled in the art that embodiments of the present technology may be practiced without some of these specific details.

The techniques introduced here can be embodied as special-purpose hardware (e.g. circuitry), as programmable circuitry appropriately programmed with software and/or firmware, or as a combination of special-purpose and programmable circuitry. Hence, embodiments may include a machine-readable medium having stored thereon instructions which may be used to program a computer (or other electronic computing devices) to perform a process. The machine-readable medium may include, but is not limited to, floppy diskettes, optical disks, compacts disc read-only memories (CD-ROMs), magneto-optical disks, ROMs, random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions.

As used herein, the term "communicatively coupled" refers to any coupling mechanism configured to exchange information (e.g., at least one electrical signal) using methods and/or devices known in the art. Non-limiting examples of communicatively coupling may include Wi-Fi, Bluetooth, wired connections, wireless connection, quantum, and/or magnets. For ease of reference, the exemplary embodiment described herein refers to Wi-Fi and/or Bluetooth, but this description should not be interpreted as exclusionary of other electrical coupling mechanisms.

As used herein, the term "coupling mechanism" refers to any apparatus known in the art configured to temporarily affix one object to at least one alternative object. Non-limiting examples of the coupling mechanism may include a screw-threaded engagement, a magnetic engagement, a bias pin, a friction fit, a nail, a rivet, and/or an adhesive. For ease of reference, the exemplary embodiment described herein refers to a screw-threaded engagement, but this description should not be interpreted as exclusionary of other coupling mechanisms.

As used herein, the term "venue" or "theater" refers to any place known in the art in which an organized event occurs, especially where concessions may be sold to patrons. Non-limiting examples of the venue or theater may include a concert, a conference, a sports event, a movie, and/or a religious congregation. For ease of reference, the exemplary embodiment described herein refers to a sports event, but this description should not be interpreted as exclusionary of other places where organized events comprising stadium seating may occur.

As used herein, the term "drink" refers to any fluid known in the art sold at events and/or theaters. Non-limiting examples of the drink may include a water, a soda, a beer, a lemonade, a coffee, and/or a slushie. For ease of reference, the exemplary embodiment described herein refers to a soda, but this description should not be interpreted as exclusionary of other fluids.

As used herein, the term "foodstuffs" refers to any substance known in the art suitable for human consumption. Non-limiting examples of foodstuffs may include concession containers of foodstuffs, a burger, a hotdog, nachos, kettle corn, a pretzel, popcorn, candy, condiments, salt, pepper, and/or seasonings. For ease of reference, the exemplary embodiment described herein refers to burgers, hotdogs, and/or candy, but this description should not be interpreted as exclusionary of other substances suitable for human consumption.

As used herein, the term "merchandise" refers to any non-drink and/or non-food material known in the art which may be brought to and/or bought at a venue and/or theater. Non-limiting examples of merchandise may include jerseys, handbags, tote bags, mobile devices, computing devices, scorecards, event publications, pamphlets, pens, and/or pencils.

As used herein, the term "locking member" refers to any component known in the art that is configured to selectively immobilize a housing of the cup holder module in a coupled configuration relative to a venue seat. The locking member may be a tab, a threaded screw, a switch, a bias pin, a stopper, a band, a clip, and/or a combination thereof. For ease of reference, the exemplary embodiment described herein refers to a tab, a switch, and/or a stopper, but this description should not be interpreted as exclusionary of other locking members.

As used herein, the terms "about," "approximately," or "roughly" refer to being within an acceptable error range (i.e., tolerance) for the particular value as determined by one of ordinary skill in the art, which will depend in part on how the value is measured or determined (e.g., the limitations of a measurement system), (e.g., the degree of precision required for a particular purpose, such as retaining and/or storing a drink (e.g., a cup), foodstuffs, and/or merchandise). As used herein, "about," "approximately," or "roughly" refer to within +25% of the numerical.

All numerical designations, including ranges, are approximations which are varied up or down by increments of 1.0, 0.1, 0.01 or 0.001 as appropriate. It is to be understood, even if it is not always explicitly stated, that all numerical designations are preceded by the term "about". It is also to be understood, even if it is not always explicitly stated, that the compounds and structures described herein are merely exemplary and that equivalents of such are known in the art and can be substituted for the compounds and structures explicitly stated herein.

Wherever the term "at least," "greater than," or "greater than or equal to" precedes the first numerical value in a series of two or more numerical values, the term "at least," "greater than" or "greater than or equal to" applies to each of the numerical values in that series of numerical values. For example, greater than or equal to 1, 2, or 3 is equivalent to greater than or equal to 1, greater than or equal to 2, or greater than or equal to 3.

Wherever the term "no more than," "less than," or "less than or equal to" precedes the first numerical value in a series of two or more numerical values, the term "no more than," "less than" or "less than or equal to" applies to each of the numerical values in that series of numerical values. For example, less than or equal to 1, 2, or 3 is equivalent to less than or equal to 1, less than or equal to 2, or less than or equal to 3.

Optimized Venue Storage Apparatus

The present disclosure pertains to an apparatus (hereinafter "venue storage apparatus") for optimized retention and/or storage of a drink (e.g., a cup), foodstuffs, and/or merchandise configured to be removably and/or permanently coupled to a venue seat (e.g., a theater and/or an arena) and methods thereof. While the venue storage apparatus may be used in a variety of settings, it is particularly useful at stadiums, arenas, and/or movie theaters. The venue storage apparatus may create more space for the patron's legs, may lead to fewer accidents from either the patron's legs and/or other event-goer's legs, may free the patron's hands for other purposes, and/or may create an overall better event experience.

Figure 2:
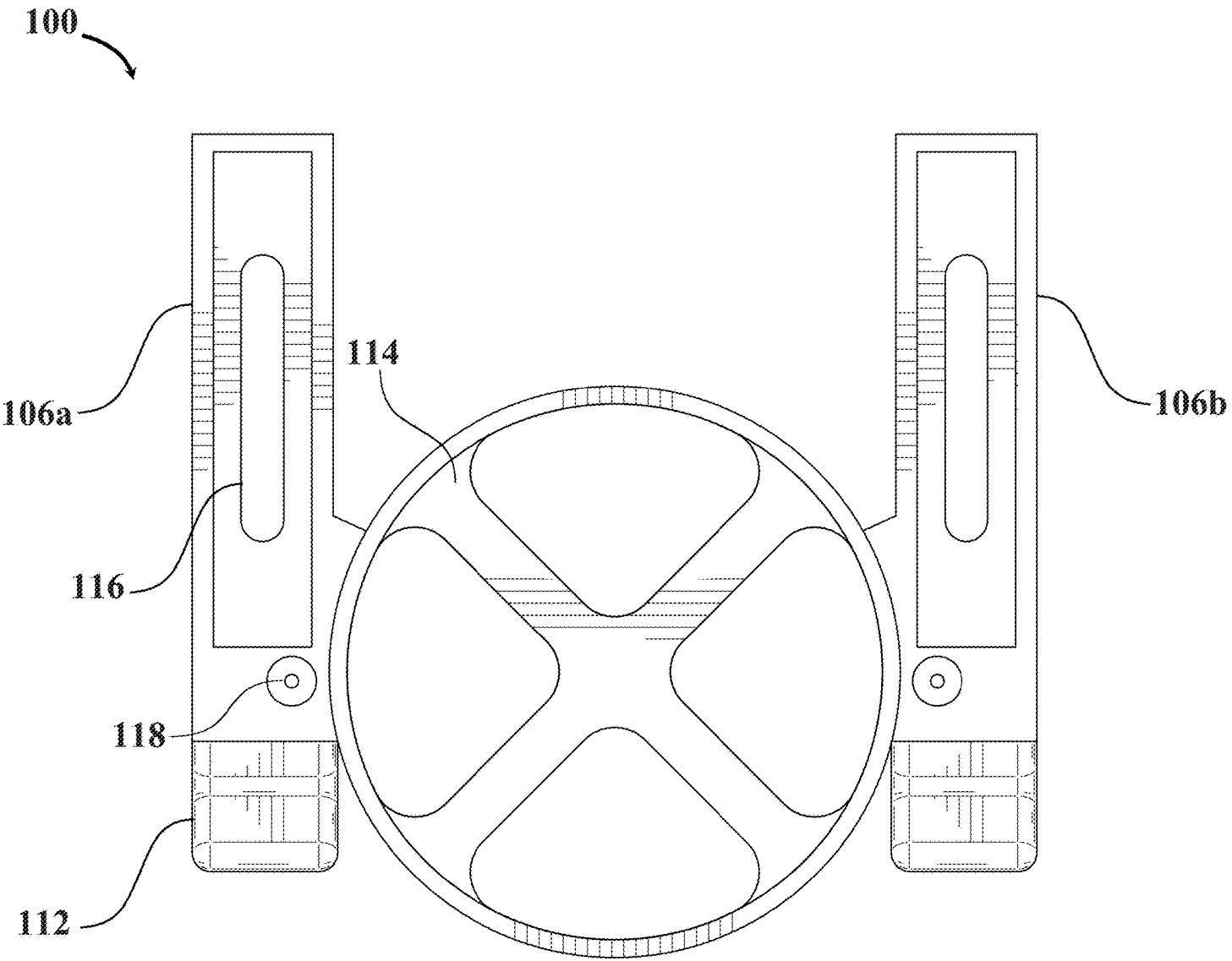
FIG. 2 is a top-planar view of the first exemplary embodiment of the venue storage apparatus of FIG. 1, according to an embodiment of the present disclosure.

Referring to FIGS. 1-7, a first exemplary embodiment of the venue storage apparatus in accordance with the subject invention is generally indicated as 100. As such, as shown in FIG. 1, in conjunction with FIGS. 2-7, in this embodiment, venue storage apparatus 100 may include a housing 102 configured to be removably coupled to at least one armrest 128 of a venue seat 126. In this manner, housing 102 may comprise a drink receptacle 104 configured to retain at least one portion of a drink 130 within at least one portion of rink receptacle 104. In this manner, drink receptacle 104 may be generally cylindrical. Moreover, as shown in FIG. 2, the sidewall of housing 102 may be generally cylindrical, such that a central axis is in a center of the sidewall of housing 102 extending into and perpendicular to a planar field. In addition, a top edge of the sidewall of housing 102 may be beveled and/or rounded to facilitate entry of the drink 130 into drink receptacle 104. In some embodiments, housing 102 of venue storage apparatus 100 may be permanently affixed and/or coupled to at least one armrest 128 of venue seat 126. In this manner, in these other embodiments, venue storage apparatus 100 may be integrated with at least one portion of armrest 128 of venue seat 126, such that a manufacturer may produce venue seat 126 comprising venue storage apparatus 100 seamlessly.

Figure 3:
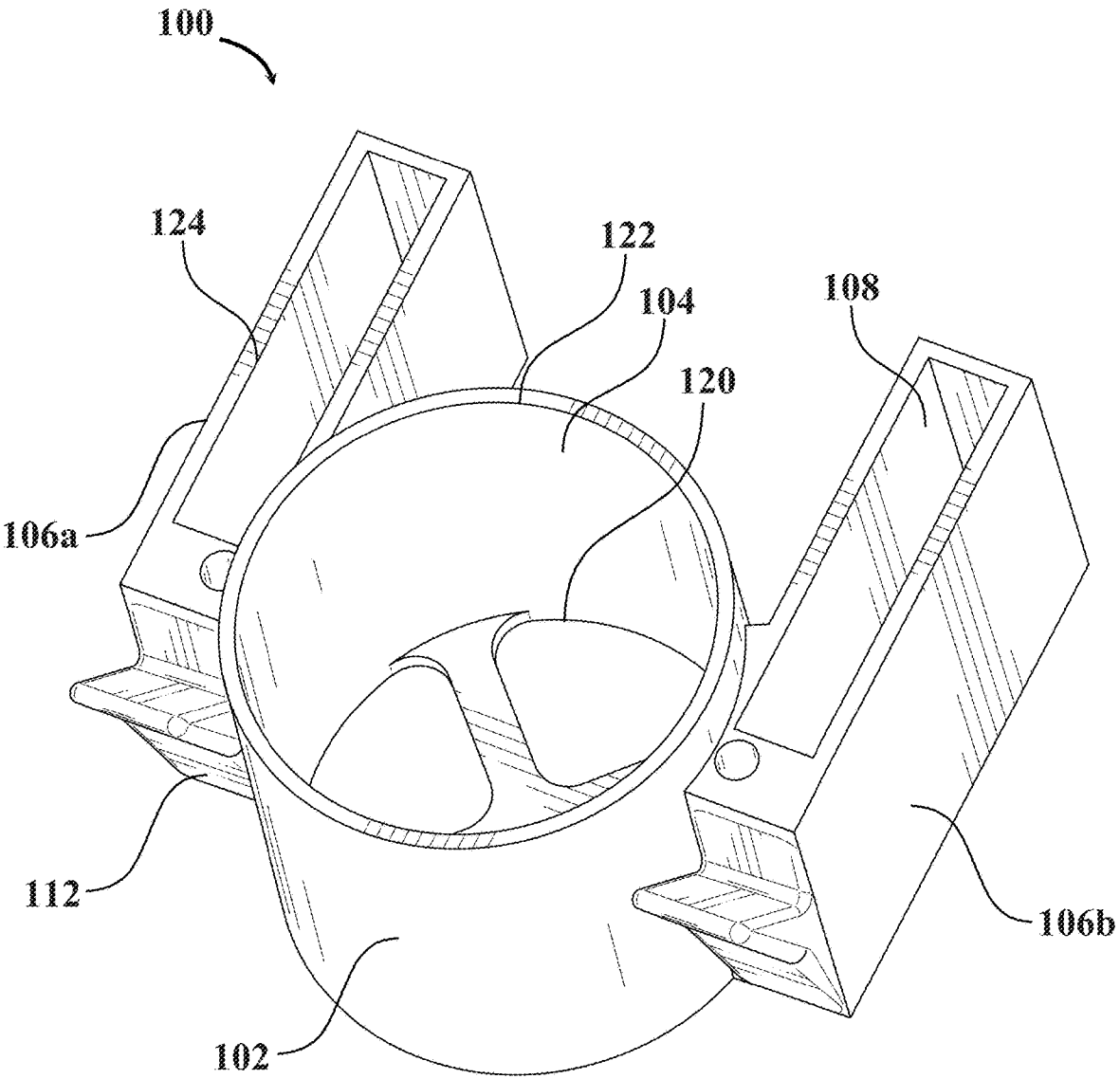
FIG. 3 is a top-perspective view of the first exemplary embodiment of the venue storage apparatus of FIG. 1, according to an embodiment of the present disclosure.
Figure 7:
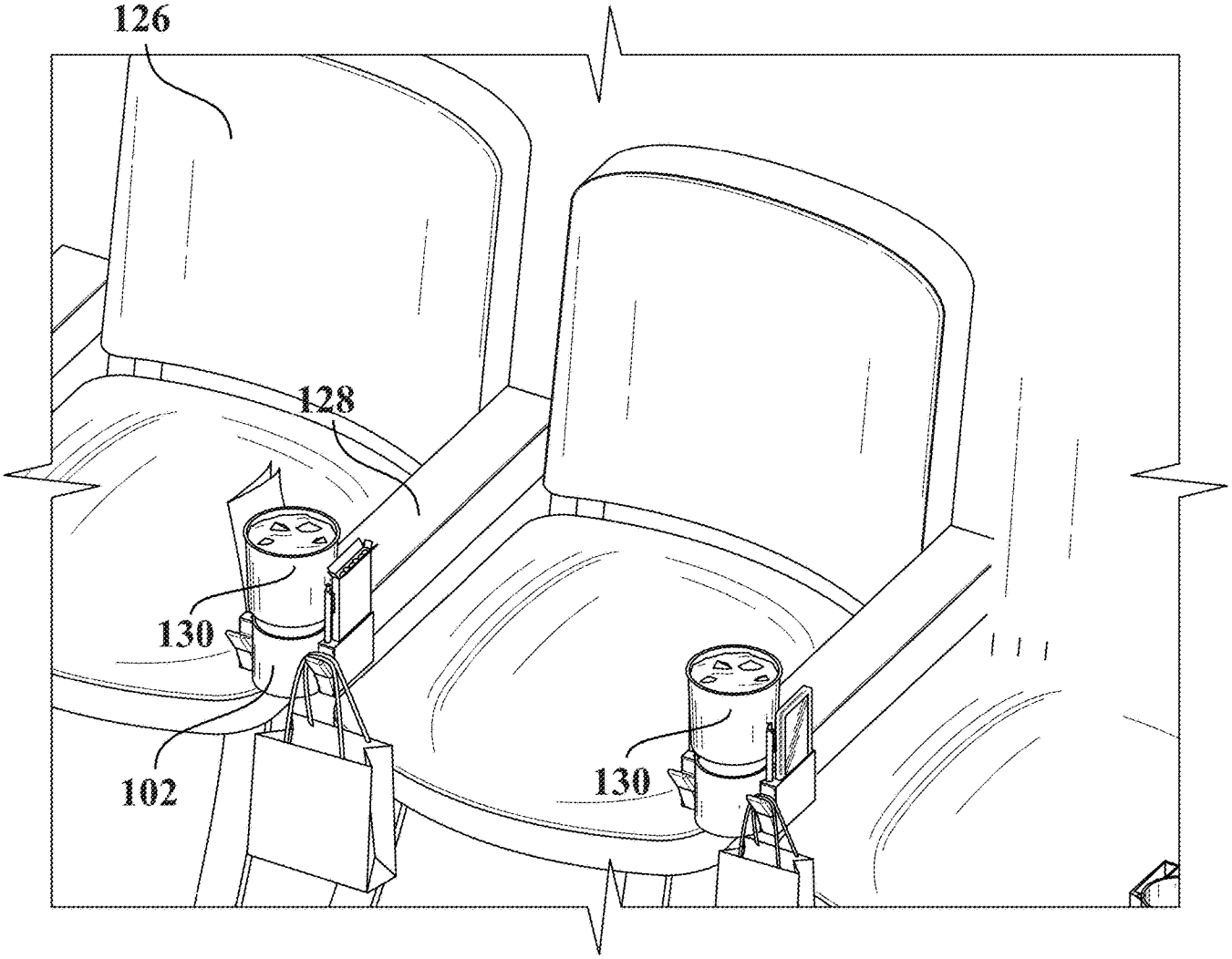
FIG. 7 is a perspective view of the first exemplary embodiment of the venue storage apparatus of FIG. 1 removably coupled to a venue seat, in which a drink, foodstuffs, mobile computing devices, writing utensils and/or merchandise are disposed about the venue storage apparatus of FIG. 1, according to an embodiment of the present disclosure, according to an embodiment of the present disclosure.

As shown in FIG. 2 and FIG. 3, in conjunction with FIG. 7, drink receptacle 104 may include a bottom wall 114 having a plurality of openings 120. In this manner, the plurality of openings 120 may be configured to allow any fluid (e.g., soda leaking from a cup) released from drink 130 and/or any residuals from any weather phenomena known in the art (e.g., rain, snow, hail, sleet, debris) to be extruded (e.g., via gravity) and/or drained from drink receptacle 104, such that drink receptacle 104 may remain clear, allowing for re-use without requiring additional clearing and/or cleaning. Additionally, in this embodiment, the plurality of openings 120 may be disposed about bottom wall 114 of housing 102, such that bottom wall 114 may be in the shape of an "X". As such, in some embodiments, bottom wall 114 may conform to any shape and/or pattern known in the art, such that bottom wall 114 may provide adequate support to retain and hold a plurality of drinks 130 throughout a predetermined period of time (e.g., at least 20 years) without requiring maintenance and/or replacement.

Figure 4:
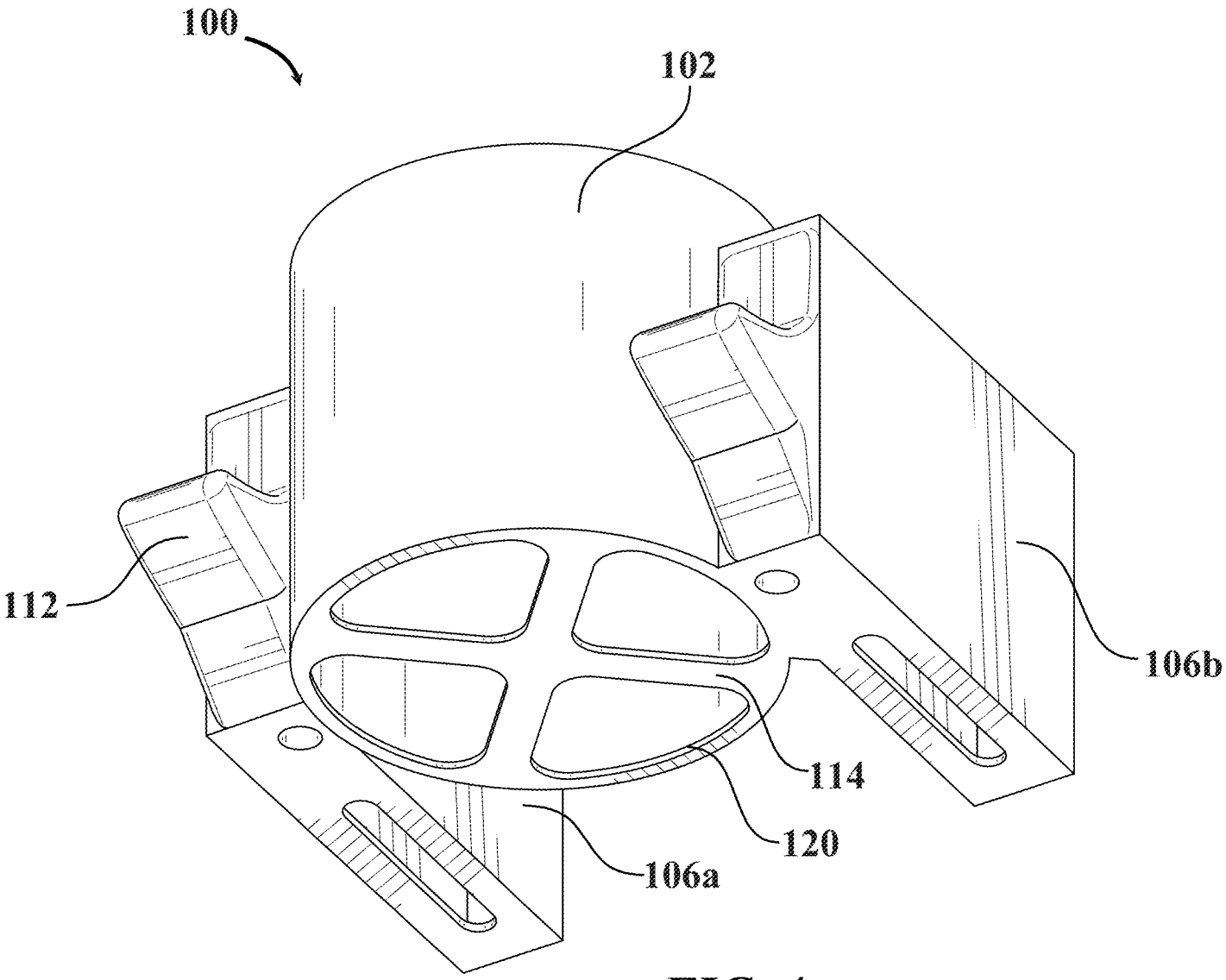
FIG. 4 is a bottom-perspective view of the first exemplary embodiment of the venue storage apparatus of FIG. 1, according to an embodiment of the present disclosure.

In addition, as shown in FIG. 3 and FIG. 4, in conjunction with FIGS. 1-2 and FIGS. 5-7, in an embodiment, venue storage apparatus 100 may further comprise at least two appendages 106*a*, 106*b* disposed about 0° and/or about 180° to the central axis of the sidewall of drink receptacle 104. As such, the at least two appendages 106*a*, 106*b*, may extend outward from housing 102 parallel to the central axis of the sidewall of drink receptacle 104. In this embodiment, at least one portion of the at least two appendages 106*a*, 106*b* may be affixed to housing 102, via an outer surface of the sidewall of drink receptacle 104. Moreover, the at least two appendages 106*a*, 106*b* may comprise a plurality of receptacles 108, 110 (hereinafter "first receptacle 108" and/or "second receptacle 110"). In this manner, first receptacle 108 may comprise a sidewall 124 generally in a rectangular shape and/or second receptacle 110 may comprise a sidewall that is generally in a cylindrical shape. Moreover, in some embodiments, a top edge of sidewall 124 of first receptacle 108 and/or a top edge of the sidewall of second receptacle 110 may be beveled and/or rounded to facilitate entry of the foodstuffs and/or merchandise into first receptacle 108 and/or second receptacle 110. Furthermore, in some embodiments, venue storage apparatus 100 may only comprise one of the at least two appendages 106*a*, 106*b*, such that venue storage apparatus may be disposed at the end of a row of venue seats 126 (e.g., venue seat 126 disposed next to a set of stairs of a venue).

As shown in FIG. 3 and FIG. 4, in conjunction with FIGS. 1-2 and FIGS. 5-7, in this embodiment, first receptacle 108 may comprises at least one opening 116 disposed about at least one portion of a bottom wall of first receptacle 108. In the same manner as disclosed above, the at least one opening 116 may be configured to allow any portion of merchandise and/or foodstuffs released from a container (not shown) (e.g., candy accidently falling out of a candy box) and/or any weather phenomena known in the art (e.g., rain, snow, hail, sleet, debris) to be extruded (e.g., via gravity) and/or drain from first receptacle 108, such that first receptacle 108 may remain clear, allowing for re-use without requiring additional clearing and/or cleaning. Moreover, in this embodiment, first receptacle 108 may be molded, such that first receptacle 108 may be configured to receive a plurality of merchandise (e.g., a mobile device and/or a pamphlet), such that the patron may dispose them within the venue storage apparatus, allowing their hands to be free during the event.

Moreover, as shown in FIG. 3 and FIG. 4, in conjunction with FIGS. 1-2 and FIGS. 5-7, in this embodiment, second receptacle 110 may comprise at least one opening 118 disposed about at least one portion of a bottom wall of second receptacle 110. The at least one opening 118 may be configured to allow any portion of merchandise and/or foodstuffs released from a container (not shown) (e.g., ink escaping and/or leaking from a pen) and/or any weather phenomena known in the art (e.g., rain, snow, hail, sleet, debris) to be extruded (e.g., via gravity) and/or drain from second receptacle 110, such that second receptacle 110 may remain clear, allowing for re-use without requiring additional clearing and/or cleaning. Moreover, in this embodiment, second receptacle 110 may be molded, such that second receptacle 110 may be configured to receive a plurality of merchandise (e.g., a pen, a pencil, and/or a straw for drink 130), such that the patron may dispose them within the venue storage apparatus, allowing their hands to be free during the event.

In an embodiment, bottom wall 114 of drink receptacle 104 may comprise a width that is less than a distance (i.e., a diameter) of an opening 122 of drink receptacle 104, such that drink receptacle 104 may support smaller drinks, cans, bottles, and/or a combination of thereof. Additionally, in this embodiment, drink receptacle 104 may include at least one tab (not shown) disposed about at least a portion of an interior surface of the sidewall of drink receptacle 104, such that smaller cups and/or smaller bottles may be prevented from falling through bottom wall 114 of drink receptacle 104. In this manner, in this embodiment, the at least one tab may be flexible enough to be pressed flat on the interior surface of the sidewall of drink receptacle 104, allowing standard-sized cups and/or larger-sized cups to be inserted in drink receptacle 104.

As such, in an embodiment, a bottom wall of first receptacle 108 and/or second receptacle 110 may also comprise a width that is less than a distance (i.e., a width and/or a diameter) of an opening of first receptacle 108 and/or second receptacle 110, such that first receptacle 108 and/or second receptacle 110 may support smaller foodstuffs and/or merchandise (e.g., writing utensils). Additionally, in this embodiment, first receptacle 108 and/or second receptacle 110 may include at least one tab (not shown) disposed about at least a portion of an interior surface of sidewall 124 of first receptacle 108 and/or the sidewall of second receptacle 110, such that smaller foodstuffs and/or merchandise may be prevented from falling through the bottom wall of first receptacle 108 and/or second receptacle 110. In this manner, in this embodiment, the at least one tab may be flexible enough to be pressed flat on the interior surface of the sidewall of first receptacle 108 and/or second receptacle 110, allowing standard sized foodstuffs and/or merchandise (e.g., candy box, condiments, writing utensils and/or styli, etc.) and/or larger sized foodstuffs and/or merchandise (e.g., pamphlet, popcorn box, straws, etc.) to be inserted in first receptacle 108 and/or second receptacle 110.

As shown in FIGS. 1-7, in an embodiment, the at least two appendages 106*a*, 106*b* may further include a hooking mechanism 112. As such, hooking mechanism 112 may be disposed about at least one portion of an outer surface of the at least two appendages 106*a*, 106*b* (e.g., hooking mechanism 112 being disposed about an end wall of the at least two appendages 106*a*, 106*b*). In this manner, hooking mechanism 112 may be configured to jut from the at least one portion of the outer surface of the at least two appendages 106*a*, 106*b* at an angle comprising a range of at least about 5° to at most about 85°. For example, in some embodiments, hooking mechanism 112 may jut at an angle of about 45° with respect to the at least two appendages 106*a*, 106*b*.

Figure 5:
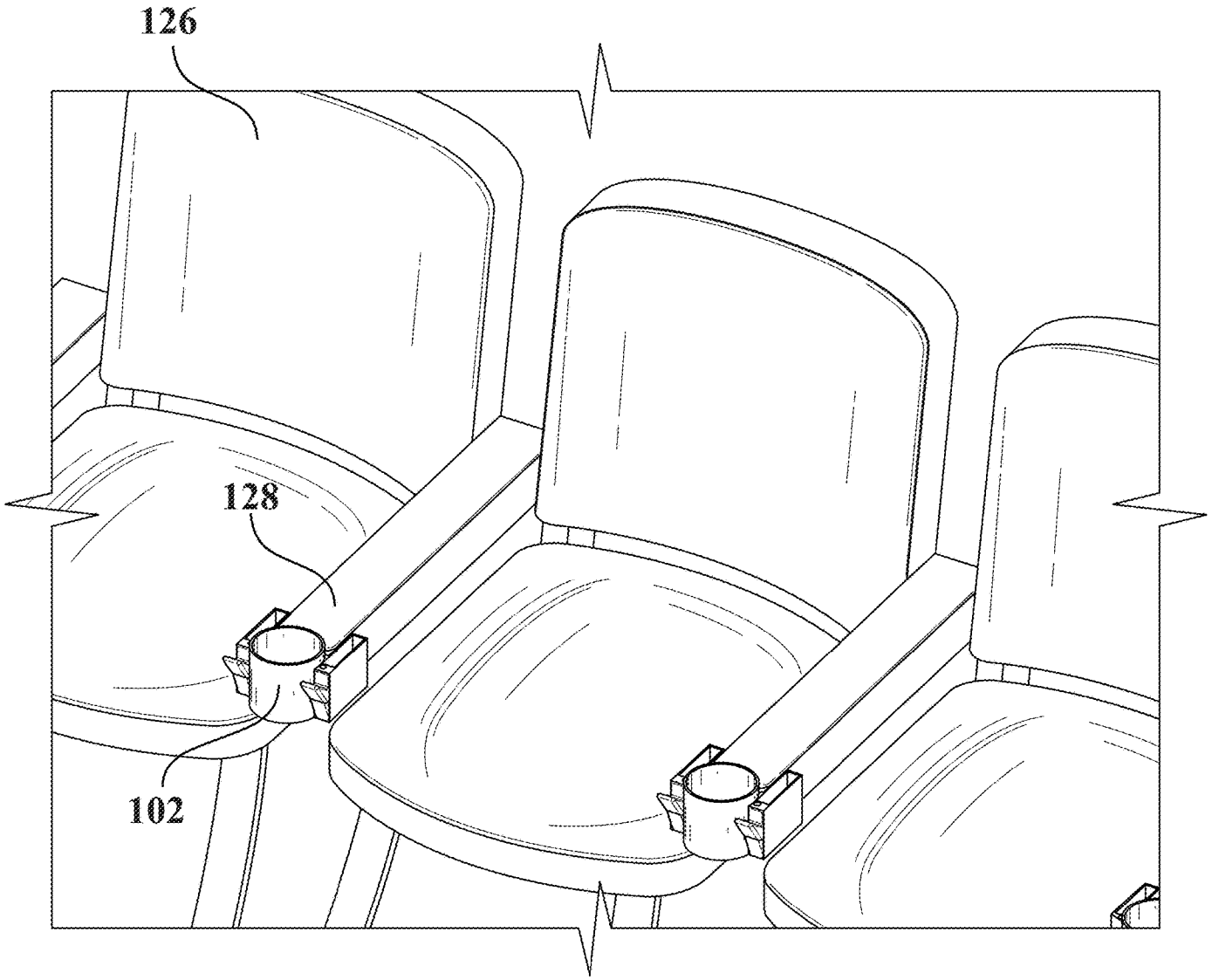
FIG. 5 is a perspective view of the first exemplary embodiment of the venue storage apparatus of FIG. 1 removably coupled to a venue seat, according to an embodiment of the present disclosure.

In this embodiment, as shown in FIGS. 1-7, hooking mechanism 112 may be configured to retain and/or hold merchandise and/or any additional person property of a patron, including but not limited to sacks, bags, handbags, and/or purses, such that the patron may be hands-free during the event. In this manner, hooking mechanism 112 may be molded from a material comprising a high level of strength, such that the merchandise may not damage hooking mechanism 112 and/or that hooking mechanism 112 may not shear, tear and/or break away from the at least two appendages 106*a*, 106*b* (e.g., a high-strength polyethylene, metal, plant materials, food grade plastics, high-grade plastic, and/or durable plastic). Furthermore, hooking mechanism 112 may be configured to retain a plurality of merchandise of the patron (e.g., a sack, a bag, and a jersey) simultaneously. Accordingly, in this embodiment, hooking mechanism 112 may be configured to securely fasten the merchandise to venue storage apparatus 100, via a friction fit (e.g., gravity), such that the merchandise may not translate and/or release from hooking mechanism 112 during the duration of the event at the venue. Furthermore, as shown in FIG. 5, hooking mechanism 112 may be disposed such that hooking mechanism 112 may be positioned away from the venue seat and/or the patron, such that the patron is not at risk of injury by hooking mechanism 112. In addition, an edge of hooking mechanism 112 may be beveled and/or rounded to facilitate entry of the merchandise onto hooking mechanism 112.

As shown in FIG. 5 and FIG. 7, in conjunction with FIGS. 1-4, in an embodiment, housing 102 of venue storage apparatus 100 may be configured to be removably and/or permanently affixed to at least one portion (e.g., a front end) of the at least one armrest 128 of venue seat 126. In this manner, housing 102 may be configured to selectively couple to the at least one portion of the at least one armrest 128 of venue seat 126, via a coupling mechanism, enabling venue storage apparatus 100 to align with the at least one armrest 126 of venue seat 128, such that a patron may easily access any drink 130, merchandise, and/or foodstuffs retained by venue storage apparatus 100. As such, in some embodiments, housing 102 of venue storage apparatus 100 may further comprise at least one aperture (not shown) disposed therethrough about at least one portion of the sidewall of housing 102 and/or at least one portion of at least one of the at least two appendages 106*a*, 106*b*, such that venue storage apparatus 100 may be removably and/or permanently affixed to the at least one armrest 128 of venue seat 126.

In an embodiment, housing 102 may comprise a locking member (not shown) disposed within housing 102 and/or drink receptacle 104. As such, the locking member may comprise an engaged position, in which locking member immobilizes housing 102 relative to the at least one armrest 128 of venue seat 126. The locking member may also comprise a disengaged position, in which the locking member may be configured to release the coupling mechanism from the at least one armrest 128, such that housing 102 of venue storage apparatus 100 may be removed from the at least one armrest 128. In this embodiment, the act of coupling housing 102 of venue storage apparatus 100, via the coupling mechanism to the at least one armrest 128 may transition the locking member into the engaged position (e.g., a tab preventing the release of the coupling mechanism, a clip and/or switch engaging at least one alternative portion of the at least one armrest 128, and/or a magnetic engagement between the at least one alternative portion of the at least one armrest and/or the locking member), immobilizing housing 102 to the at least one armrest 128. In this manner, when the coupling mechanism is released, the locking member may be disengaged, releasing housing 102 of venue storage apparatus 100 from the at least one armrest 128 of venue seat 126.

Figure 6:
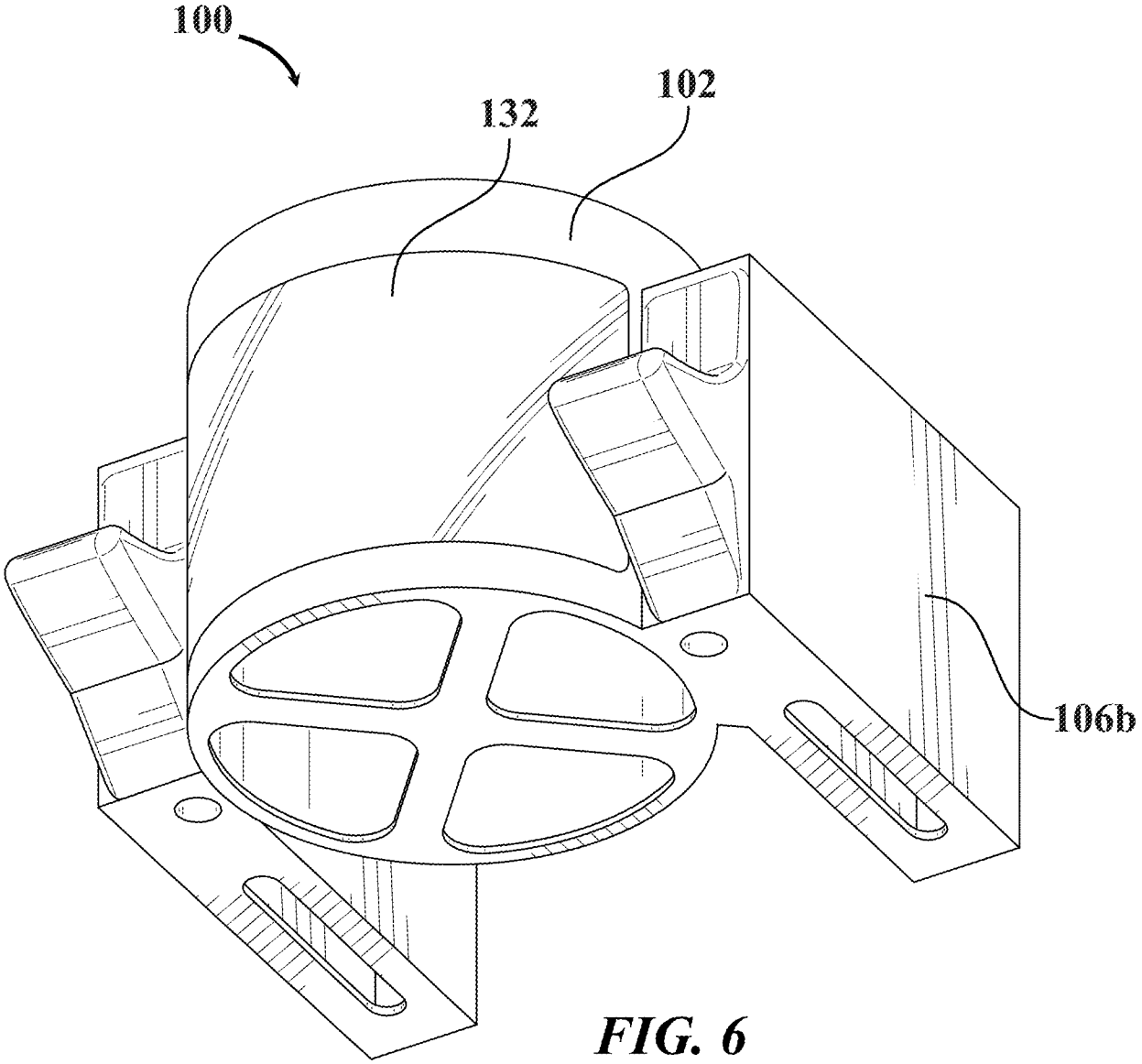
FIG. 6 is a bottom-perspective view of the first exemplary embodiment of the venue storage apparatus of FIG. 1 comprising a display device, according to an embodiment of the present disclosure.

Furthermore, as shown in FIG. 6, in conjunction with FIGS. 1-5, in an embodiment, venue storage apparatus 100 may include at least one processor and/or at least one printed circuit board (hereinafter "PCB") or similar computing unit disposed within at least one portion of housing 102. As such, in this embodiment, venue storage apparatus 100 may comprise a display device 132 disposed upon and/or within at least one portion of the outer surface of housing 102 and/or at least one portion of the outer surface of at least one of the at least two appendages 106*a*, 106*b* of venue storage apparatus 100 (e.g., display device 132 is seamless and/or flush with the outer surface of housing 102 and/or the outer surface of at least one of the at least two appendages 106*a*, 106*b*), display device 132 being communicatively coupled to the at least one processor and/or the PCB. Accordingly, the at least one processor and/or the at least one PCB may be communicatively coupled to a Wi-Fi and/or Bluetooth access point, in order to allow communication between a computing device and/or a mobile computing device and display device 132. As such, the computing device and/or mobile computing device may be configured to transmit a signal to the at least one processor and/or the at least one PCB, such that the at least one processor, via the at least one PCB, may be configured to transmit a signal to display device 132 to display and/or present information in visual form (e.g., a set of images and/or a video).

Accordingly, in this embodiment, display device 132 of venue storage apparatus 100 may be configured to display specific information and/or advertisements pertaining to events at the venue and/or theater and/or any third-party advertisements related to the event. Additionally, display device 132 may be configured to display designs specific to the event (hereinafter "venue-related material") (e.g., score of the game, statistics of sports players, theater program, seating number, sports team logo, and/or venue/theater logo). In some embodiments, display device 132 may be configured to output a light, such that when a lighting system at a venue and/or theater has been diminished for the event, the patron may easily find their seat and/or walk through a seating isle at the venue and/or theater.

In this embodiment, display device 132 may be any output device known in the art configured to present information in visual and/or tactile form. Non-limiting examples of display device 132 may include an LED screen, a LCD screen, an OLED screen, and/or a plasma screen. For ease of reference, the exemplary embodiment disclosed herein refers to an LED screen and/or an OLED screen, but this description should not be interpreted as exclusionary of other output devices. In this embodiment, display device 132 may comprise a protective screen, such that display device 132 may be protected from day-to-day wear (e.g., scratches, broken pixels, etc.).

Additionally, in an embodiment, venue storage apparatus 100 and any of its component parts may be formed from a variety of materials. Non-limiting examples of the materials may include plant materials, food grade plastics, pressed molded fiber, disposable plastic, durable plastic, polyethylene, polystyrene, wood, and/or metal (e.g., brass, aluminum, and/or titanium). For example, in some embodiments, venue storage apparatus 100 may be a formed from molded fiber and/or recycled materials. In some embodiments, venue storage apparatus 100 may be formed from polymers or plastics that allow venue storage apparatus 100 to be cleaned and/or reused. In an embodiment, venue storage apparatus 100 may also be decorated and/or etched with designs specific to the events and/or preferences of the patron (e.g., favorite sports team or advertising).

Figure 8:
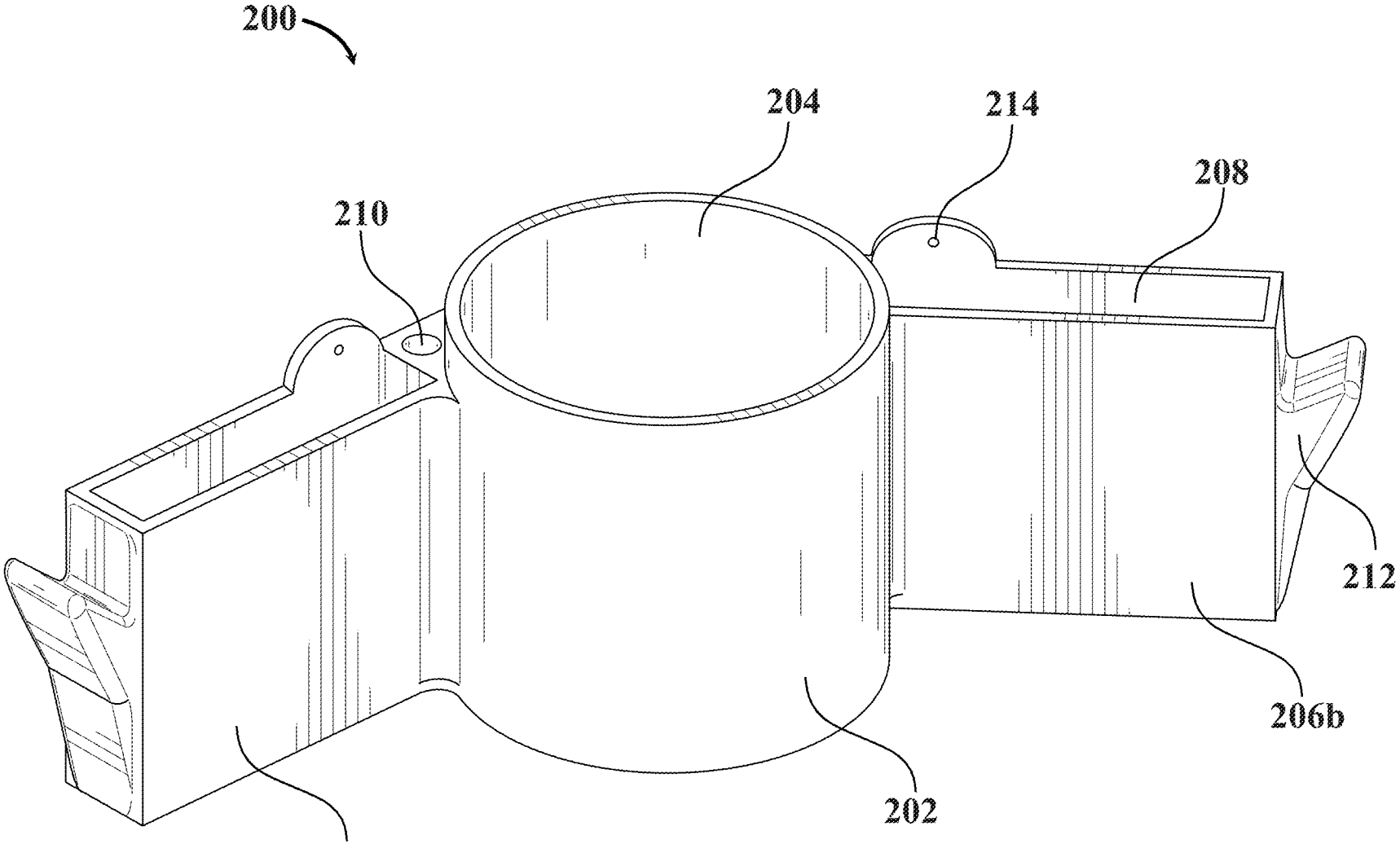
FIG. 8 is a front-perspective view of a second exemplary embodiment of a venue storage apparatus, according to an embodiment of the present disclosure.
Figure 9:
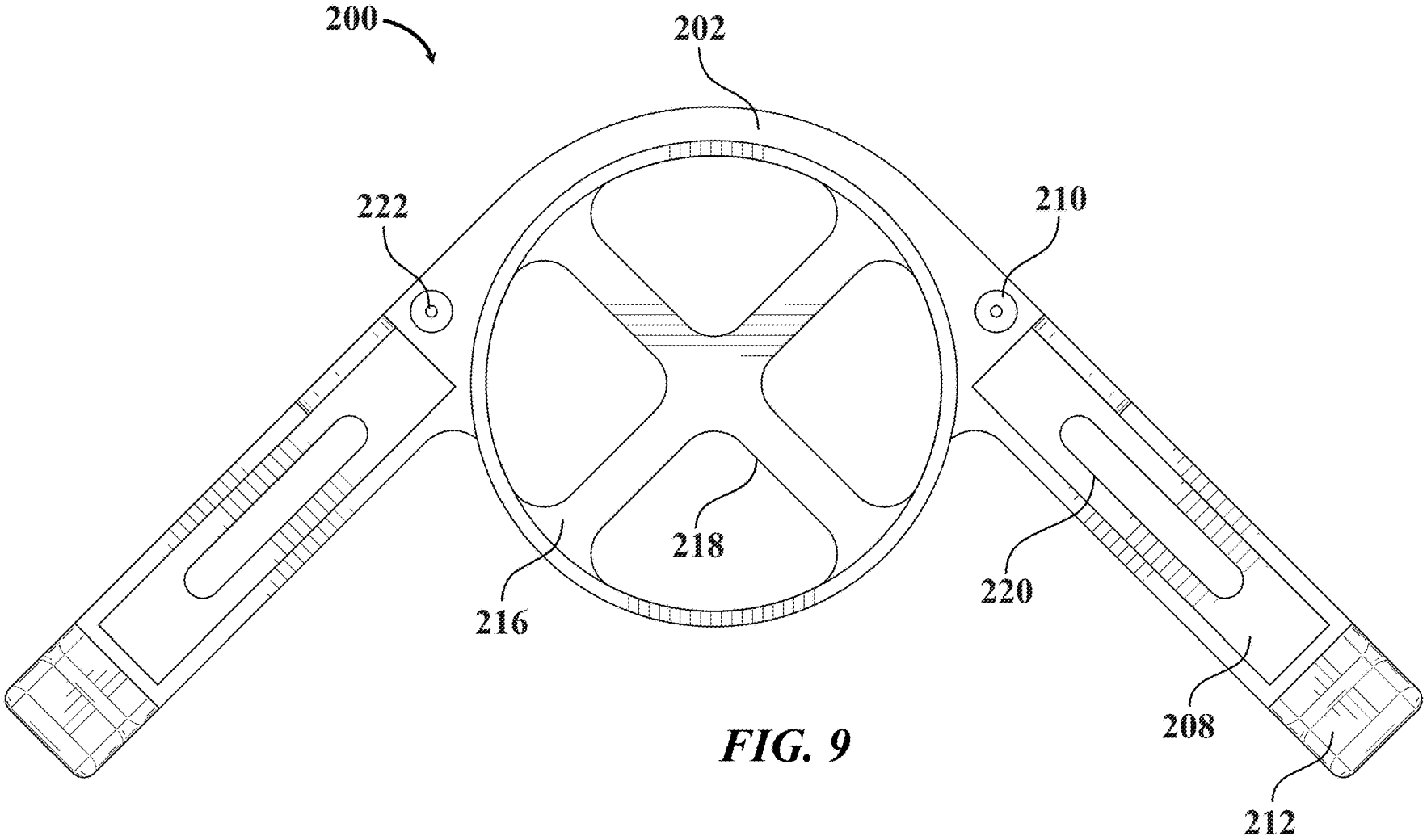
FIG. 9 is a top-planar view of the second exemplary embodiment of the venue storage apparatus of FIG. 8, according to an embodiment of the present disclosure.

Moreover, referring now to FIGS. 8-14, a second exemplary embodiment of the venue storage apparatus in accordance with the subject invention is generally indicated as 200. As such, as shown in FIG. 8, in conjunction with FIGS. 9-14, in this embodiment, venue storage apparatus 200 may include a housing 202 configured to be removably coupled to at least one portion of a seatback 226 (i.e., back of seat) of a venue seat 224. In this manner, housing 202 may comprise a drink receptacle 204 configured to retain at least one portion of a drink 230 within at least one portion of drink receptacle 204. In this manner, drink receptacle 204 may be generally cylindrical. Moreover, as shown in FIG. 9, the sidewall of housing 202 may be generally cylindrical, such that a central axis is in a center of the sidewall of housing 202 extending into and perpendicular to a planar field. In addition, a top edge of the sidewall of housing 202 may be beveled to facilitate entry of the drink 230 into drink receptacle 204. Additionally, in some embodiments, housing 202 of venue storage apparatus 200 may be permanently affixed and/or coupled to at least one portion of a seatback 226 (i.e., back of seat) of a venue seat 224. In this manner, in these other embodiments, venue storage apparatus 200 may be integrated with least one portion of a seatback 226 (i.e., back of seat) of a venue seat 224, such that a manufacturer may produce venue seat 224 comprising venue storage apparatus 200 seamlessly.

Figure 10:
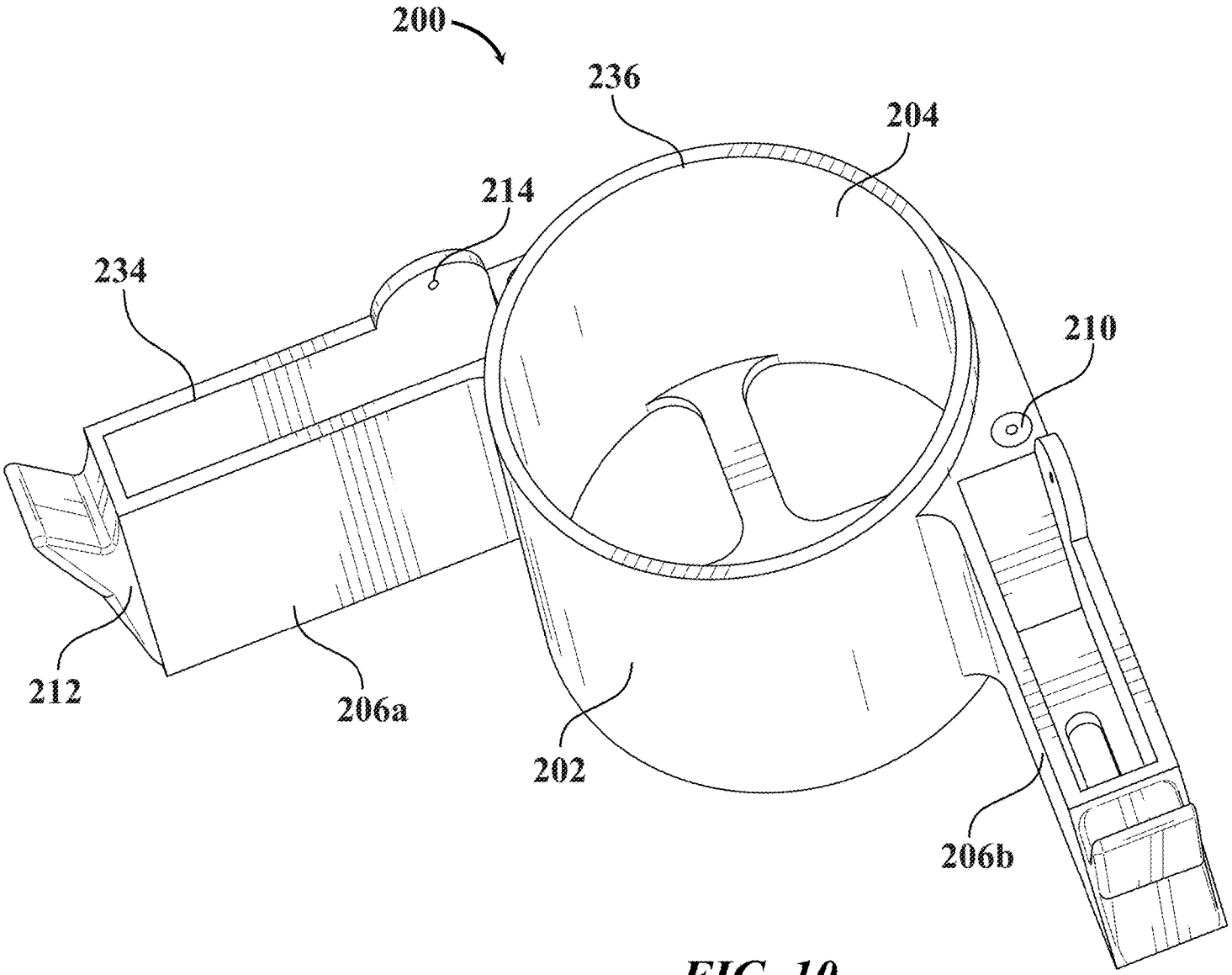
FIG. 10 is a top-perspective view of the second exemplary embodiment of the venue storage apparatus of FIG. 8, according to an embodiment of the present disclosure.
Figure 14:
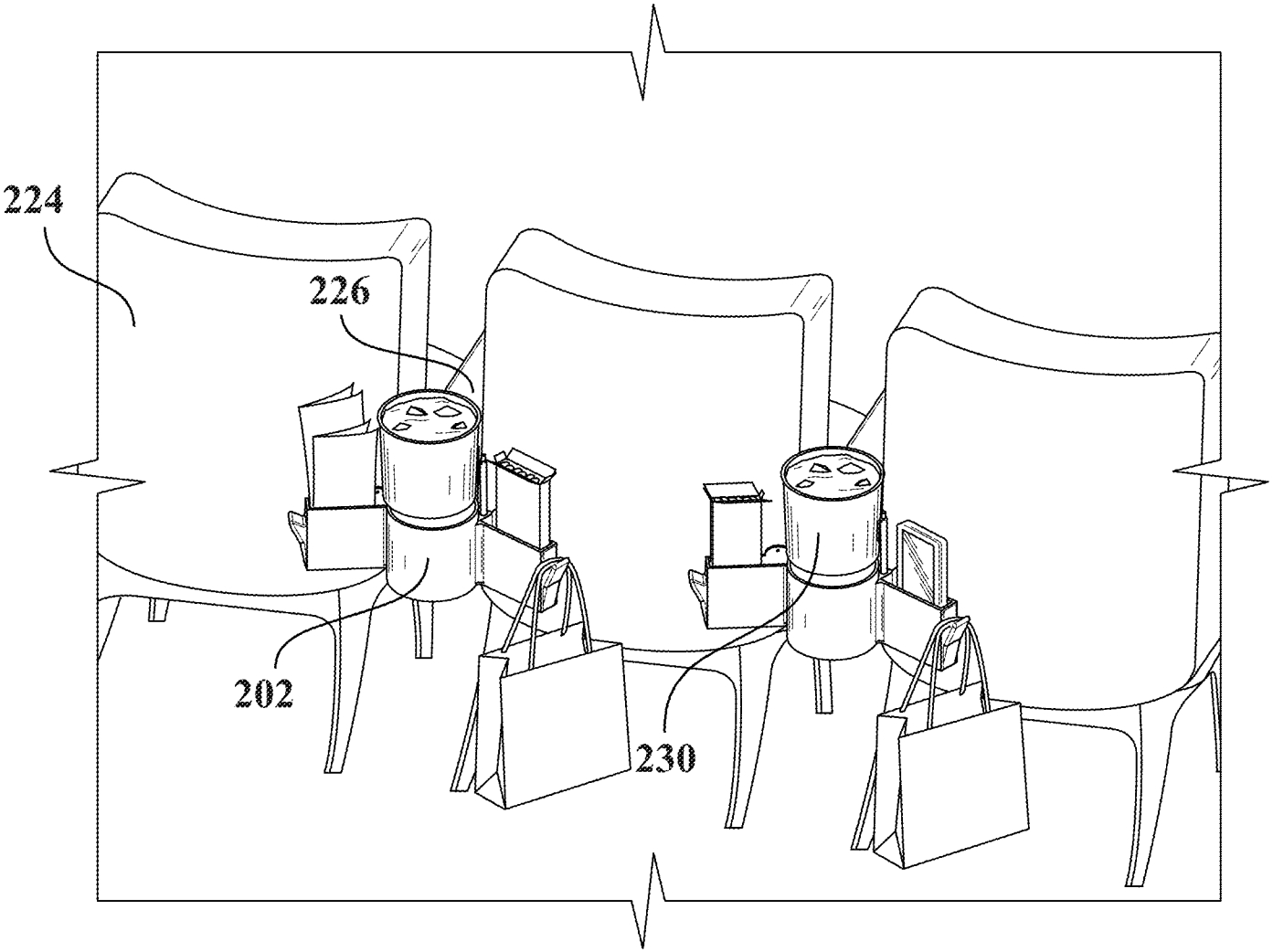
FIG. 14 is a perspective view of the second exemplary embodiment of the venue storage apparatus of FIG. 8 removably coupled to a venue seat, in which a drink, mobile computing devices, writing utensils, foodstuffs, and/or merchandise are disposed about the venue storage apparatus of FIG. 8, according to an embodiment of the present disclosure, according to an embodiment of the present disclosure.

As shown in FIG. 9 and FIG. 10, in conjunction with FIG. 14, drink receptacle 204 may include a bottom wall 216 having a plurality of openings 218. In this manner, the plurality of openings 218 may be configured to allow any fluid (e.g., soda leaking from a cup) released from drink 30 and/or any residuals from any weather phenomena known in the art (e.g., rain, snow, hail, sleet, debris) to be extruded (e.g., via gravity) and/or drained from drink receptacle 204, such that drink receptacle 204 may remain clear, allowing for re-use without requiring additional clearing and/or cleaning. Additionally, in this embodiment, the plurality of openings 218 may be disposed about bottom wall 216 of drink receptacle 204, such that bottom wall 216 may be in the shape of an "X".

As such, in some embodiments, bottom wall 216 may conform to any shape and/or pattern known in the art, such that bottom wall 216 may provide adequate support to retain and hold a plurality of drinks 230 throughout a predetermined period of time (e.g., at least 20 years) without requiring maintenance and/or replacement.

Figure 11:
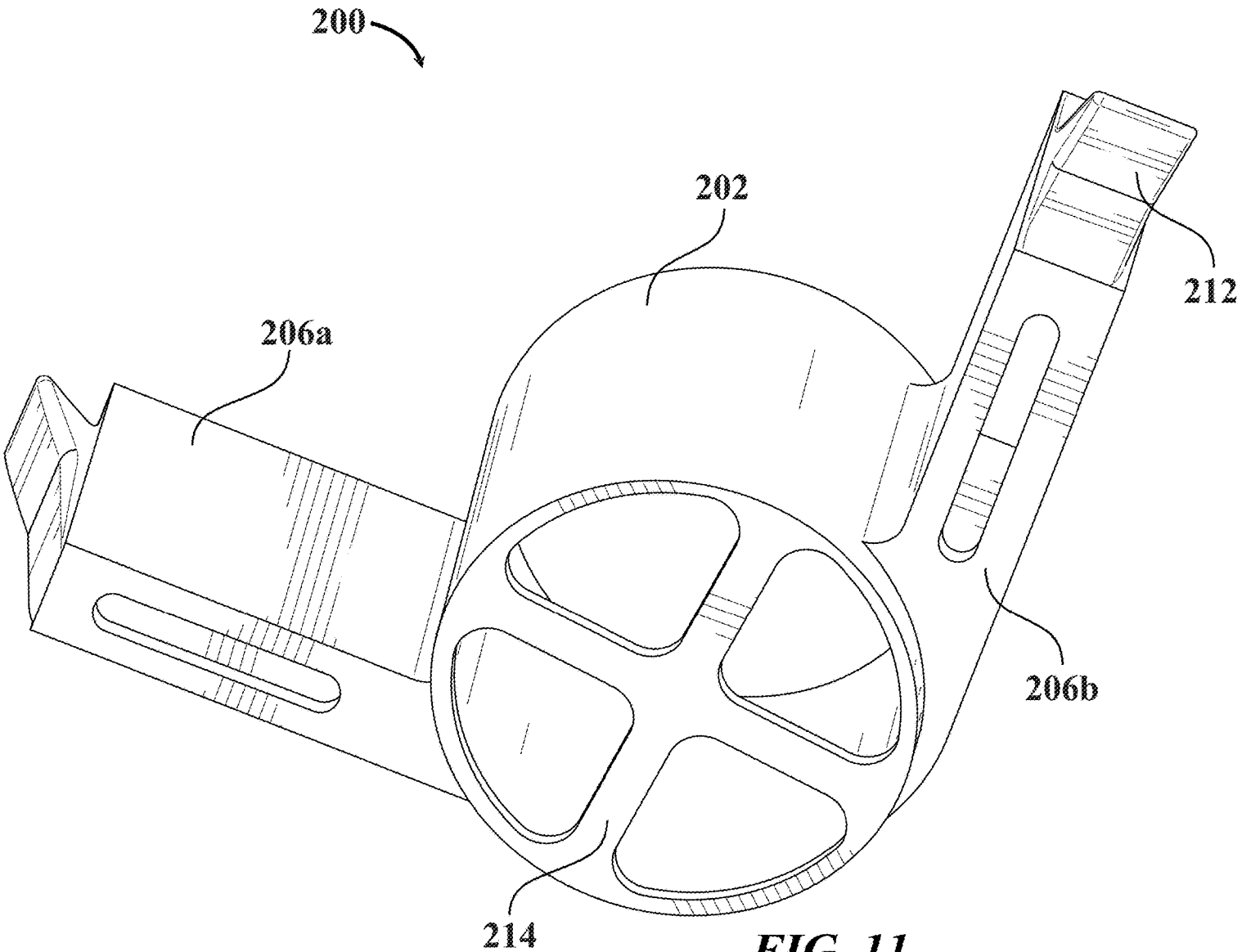
FIG. 11 is a bottom-perspective view of the second exemplary embodiment of the venue storage apparatus of FIG. 8, according to an embodiment of the present disclosure.

In addition, as shown in FIG. 10 and FIG. 11, in conjunction with FIGS. 8-9 and FIGS. 12-14, in an embodiment, venue storage apparatus 200 may further comprise at least two appendages 206*a*, 206*b* disposed about at least one portion of the sidewall of drink receptacle 204, such that the at least two appendages may extend outwardly from housing 202 at an angle comprising a range of at least about 5° to at most about 85° to the central axis of the sidewall of drink receptacle 204. For example, in some embodiments, the at least two appendages 206*a*, 206*b* may be disposed about the at least one portion of the sidewall of drink receptacle 204 at an angle conforming with at least one portion of a seatback positioned in front of the at least two appendages

206*a*, 206*b* (e.g., an angle of 45°) to the central axis of the sidewall of drink receptacle 204. Furthermore, in some embodiments, venue storage apparatus 200 may only comprise one of the at least two appendages 206*a*, 206*b*, such that venue storage apparatus may be disposed at the end of a row of venue seats 224 (e.g., venue seat 224 disposed next to a set of stairs of an entertainment venue).

In an embodiment, at least one portion of the at least two appendages 206*a*, 206*b* may also be affixed to housing 202, via an outer surface of the sidewall of drink receptacle 204. Moreover, the at least two appendages 206*a*, 206*b* may comprise a plurality of receptacles 208, 210 (hereinafter "first receptacle 208" and/or "second receptacle 210"). In this manner, first receptacle 208 may comprise a sidewall 234 generally in a rectangular shape and/or second receptacle 210 may comprise a sidewall that is generally in a cylindrical shape. Moreover, in some embodiments, a top edge of sidewall 234 of first receptacle 208 and/or a top edge of the sidewall of second receptacle 210 may be beveled to facilitate entry of the foodstuffs and/or merchandise into first receptacle 208 and/or second receptacle 210.

In this embodiment, first receptacle 208 may comprise at least one opening 220 disposed about at least one portion of a bottom wall of first receptacle 208. In the same manner as disclosed above, the at least one opening 220 may be configured to allow any portion of merchandise and/or foodstuffs released from a container (not shown) (e.g., candy accidently falling out of a candy box) and/or any weather phenomena known in the art (e.g., rain, snow, hail, sleet, debris) to be extruded (e.g., via gravity) and/or drain from first receptacle 208, such that first receptacle 208 may remain clear, allowing for re-use without requiring additional clearing and/or cleaning. Moreover, in this embodiment, first receptacle 208 may be molded, such that first receptacle 208 may be configured to receive a plurality of merchandise (e.g., a mobile device and/or a pamphlet), such that the patron may dispose them within the venue storage apparatus, allowing their hands to be free during the event.

Moreover, in this embodiment, second receptacle 210 may comprise at least one opening 222 disposed about at least one portion of a bottom wall of second receptacle 210. The at least one opening 222 may be configured to allow any portion of merchandise and/or foodstuffs released from a container (not shown) (e.g., ink escaping and/or leaking from a pen) and/or any weather phenomena known in the art (e.g., rain, snow, hail, sleet, debris) to be extruded (e.g., via gravity) and/or drain from second receptacle 210, such that second receptacle 210 may remain clear, allowing for re-use without requiring additional clearing and/or cleaning. Moreover, in this embodiment, second receptacle 210 may be molded, such that second receptacle 210 may be configured to receive a plurality of merchandise (e.g., a pen, a pencil, a mobile computing device stylus, and/or a straw for drink 230), such that the patron may dispose them within the venue storage apparatus, allowing their hands to be free during the event.

In an embodiment, bottom wall 216 of drink receptacle 204 may comprise a width that is less than a distance (i.e., a diameter) of an opening 236 of drink receptacle 204, such that drink receptacle 204 may support smaller drinks, cans, bottles, and/or a combination of thereof. Additionally, in this embodiment, drink receptacle 204 may include at least one tab (not shown) disposed about at least a portion of an interior surface of the sidewall of drink receptacle 204, such that smaller cups and/or smaller bottles may be prevented from falling through bottom wall 216 of drink receptacle 204. In this manner, in this embodiment, the at least one tab may be flexible enough to be pressed flat on the interior surface of the sidewall of drink receptacle 204, allowing standard sized cups and/or larger sized cups to be inserted in drink receptacle 204.

As such, in an embodiment, a bottom wall of first receptacle 208 and/or second receptacle 210 may also comprise a width that is less than a distance (i.e., a width and/or a diameter) of an opening of first receptacle 208 and/or second receptacle 210, such that first receptacle 208 and/or second receptacle 210 may support smaller foodstuffs and/or merchandise (e.g., pencils, pens, and/or a mobile computing device stylus). Additionally, in this embodiment, first receptacle 208 and/or second receptacle 210 may include at least one tab (not shown) disposed about at least a portion of an interior surface of sidewall 234 of first receptacle 208 and/or the sidewall of second receptacle 210, such that smaller foodstuffs and/or merchandise may be prevented from falling through the bottom wall of first receptacle 208 and/or second receptacle 210. In this manner, in this embodiment, the at least one tab may be flexible enough to be pressed flat on the interior surface of the sidewall of first receptacle 208 and/or second receptacle 210, allowing standard sized foodstuffs and/or merchandise and/or larger sized foodstuffs and/or merchandise to be inserted in first receptacle 208 and/or second receptacle 210.

As shown in FIGS. 8-14, in an embodiment, the at least two appendages 206*a*, 206*b* may further include a hooking mechanism 212. As such, hooking mechanism 212 may be disposed about at least one portion of an outer surface of the at least two appendages 206*a*, 206*b* (e.g., hooking mechanism 212 being disposed about an end wall of the at least two appendages 206*a*, 206*b*). In this manner, hooking mechanism 212 may be configured to jut from the at least one portion of the outer surface of the at least two appendages 206*a*, 206*b* at an angle comprising a range of at least 5° to at most 85°. For example, in some embodiments, hooking mechanism 212 may jut at an angle of about 45° with respect to the at least two appendages 206*a*, 206*b*.

Figure 12:
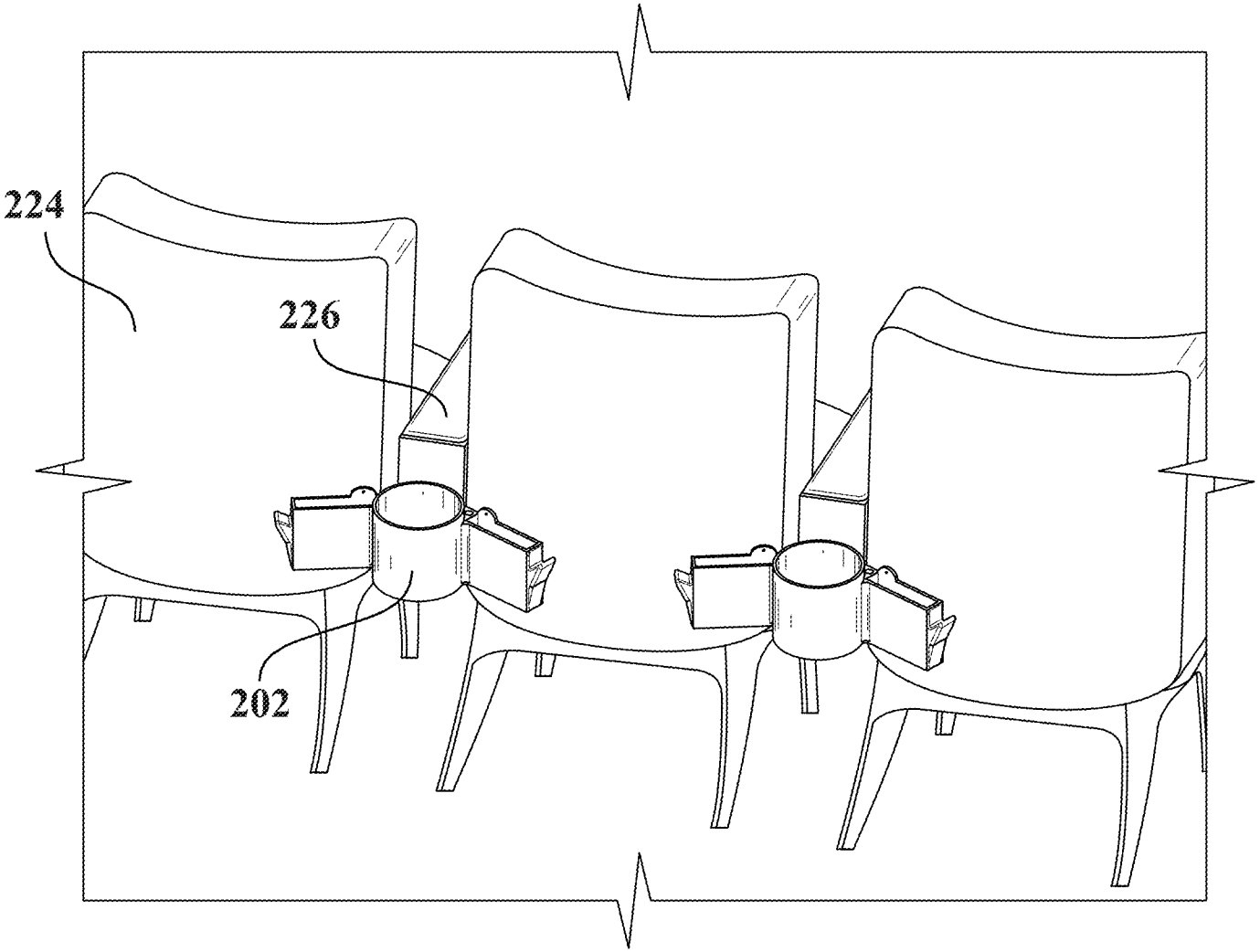
FIG. 12 is a perspective view of the second exemplary embodiment of the venue storage apparatus of FIG. 8 removably coupled to a venue seat, according to an embodiment of the present disclosure.

In this embodiment, as disclosed above, as shown in FIGS. 8-14, hooking mechanism 212 may be configured to retain and/or hold merchandise and/or any additional property of a patron, including but not limited to sacks, bags, handbags, purses, and/or hangers, such that the patron may be hands-free during the event. In this manner, hooking mechanism 212 may be molded from a material comprises a high level of strength, such that the merchandise may not damage hooking mechanism 212 and/or that hooking mechanism 212 may not shear, tear, and/or break away from the at least two appendages 206*a*, 206*b* (e.g., a high-strength polyethylene, metal, plant materials, food grade plastics, high-grade plastic, and/or durable plastic). Furthermore, hooking mechanism 212 may be configured to retain a plurality of merchandise of the patron (e.g., a sack, a bag, and a jersey) simultaneously. Accordingly, in this embodiment, hooking mechanism 212 may be configured to securely fasten the merchandise to venue storage apparatus 200, via a friction fit (e.g., gravity), such that the merchandise may not translate and/or release from hooking mechanism 212 during the duration of the event at the venue. Furthermore, as shown in FIG. 12, hooking mechanism 212 may be disposed such that hooking mechanism 212 may be positioned away from the venue seat and/or the patron, such that the patron is not at risk of injury by hooking mechanism 212. In addition, an edge of hooking mechanism 212 may be beveled and/or rounded to facilitate entry of the merchandise onto hooking mechanism 112.

As shown in FIG. 12 and FIG. 14, in conjunction with FIGS. 8-11, in an embodiment, housing 202 of venue storage apparatus 200 may be configured to be removably affixed coupled to at least one portion of a seatback 226 of venue seat 224. In this manner, housing 202 may be configured to selectively couple to the at least one portion of the at least one portion of a seatback 226 of venue seat 224, via a coupling mechanism, enabling venue storage apparatus 200 to align with the at least one portion of a seatback 226 of venue seat 224, such that a patron may easily access any drink 230, merchandise, and/or foodstuffs retained by venue storage apparatus 200. As such, in some embodiments, housing 202 of venue storage apparatus 200 may further comprise at least one aperture 214 disposed therethrough about at least one portion of the sidewall of housing 202 and/or at least one portion of at least one of the at least two appendages 206*a*, 206*b*, such that venue storage apparatus 200 may be removably and/or permanently affixed to the at least one portion of a seatback 226 of venue seat 224.

In an embodiment, as disclosed above, housing 202 may also comprise a locking member (not shown) disposed within housing 202 and/or drink receptacle 204. As such, the locking member may comprise an engaged position, in which locking member immobilizes housing 202 relative to the at least one portion of a seatback 226 of venue seat 224. The locking member may also comprise a disengaged position, in which the locking member may be configured to release the coupling mechanism from the at least one portion of a seatback 226 of venue seat 224, such that housing 202 of venue storage apparatus 200 may be removed from the at least one portion of a seatback 226 of venue seat 224. In this embodiment, the act of coupling housing 202 of venue storage apparatus 200, via the coupling mechanism, to the at least one portion of a seatback 226 of venue seat 224 may transition the locking member into the engaged position (e.g., a tab preventing the release of the coupling mechanism, a clip and/or switch engaging at least one alternative portion of the at least one portion of a seatback 226 of venue seat 224, and/or a magnetic engagement between the at least one alternative portion of the at least one armrest and/or the locking member), immobilizing housing 202 to the at least one portion of a seatback 226 of venue seat 224. In this manner, when the coupling mechanism is released, the locking member may be disengaged, releasing housing 202 of venue storage apparatus 200 from the at least one portion of a seatback 226 of venue seat 224.

Figure 13:
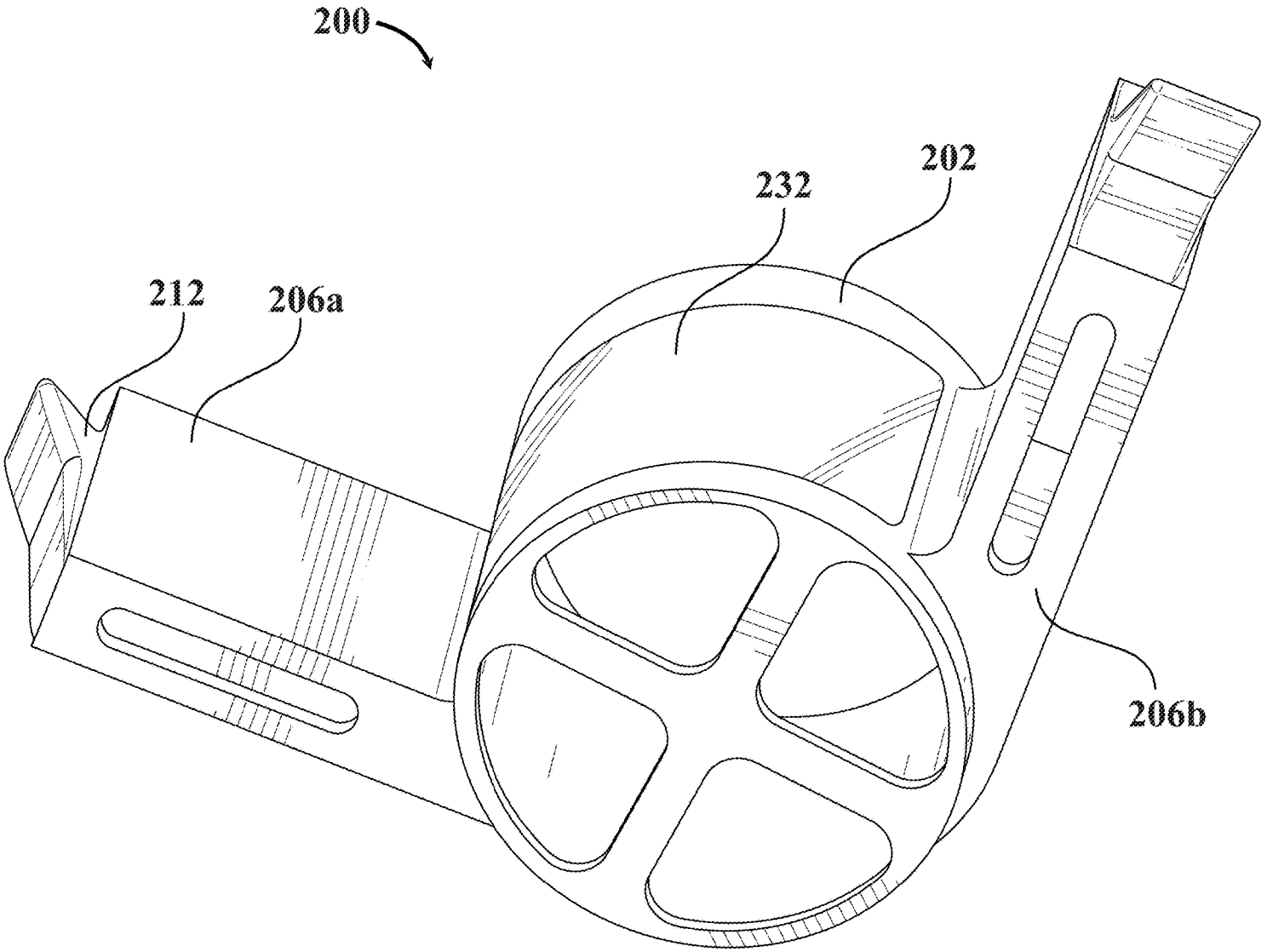
FIG. 13 is a bottom-perspective view of the second exemplary embodiment of the venue storage apparatus of FIG. 8 comprising a display device, according to an embodiment of the present disclosure.

Furthermore, as shown in FIG. 13, in conjunction with FIGS. 8-12, in an embodiment, venue storage apparatus 200 may include at least one processor and/or at least one PCB or other computing unit disposed within at least one portion of housing 202. As such, in this embodiment, venue storage apparatus 200 may comprise a display device 232 disposed upon and/or within at least one portion of the outer surface of housing 202 and/or at least one portion of the outer surface of at least one of the at least two appendages 206*a*, 206*b* of venue storage apparatus 200 (e.g., display device 232 is seamless and/or flush with the outer surface of housing 202 and/or the outer surface of at least one of the at least two appendages 206*a*, 206*b*), display device 232 being communicatively coupled to the at least one processor and/or the PCB. Accordingly, the at least one processor and/or the at least one PCB may be communicatively coupled to a Wi-Fi and/or Bluetooth access point, in order to allow communication between a computing device and/or a mobile computing device and display device 232. As such, the computing device and/or mobile computing device may be configured to transmit a signal to the at least one processor and/or the at least one PCB, such that the at least one processor, via the at least one PCB, may be configured to transmit a signal to display device 232 to display and/or present information in visual form (e.g., a set of images and/or a video).

Accordingly, in this embodiment, display device 232 of venue storage apparatus 200 may be configured to display specific information and/or advertisements pertaining to events at the venue and/or theater and/or any third-party advertisements related to the event. Additionally, display device 232 may be configured to display designs specific venue-related material (e.g., score of the game, statistics of sports players, theater program, seating number, sports team logo, and/or venue/theater logo). In some embodiments, display device 232 may be configured to output a light, such that when a lighting system at a venue and/or theater has been diminished for the event, the patron may easily find their seat and/or walk through a seating isle at the venue and/or theater.

In this embodiment, as disclosed above, display device 232 may be output device known in the art configured to present information in visual and/or tactile form. Non-limiting examples of display device 232 may include an LED screen, a LCD screen, an OLED screen, and/or a plasma screen. For ease of reference, the exemplary embodiment disclosed herein refers to an LED screen and/or an OLED screen, but this description should not be interpreted as exclusionary of other output devices. In this embodiment, display device 232 may comprise a protective screen, such that display device 232 may be protected from day-to-day wear (e.g., scratches, broken pixels, etc.).

Additionally, in an embodiment, venue storage apparatus 200 and any of its component parts may be formed from a variety of materials. Non-limiting examples of the materials may include plant materials, food grade plastics, pressed molded fiber, disposable plastic, durable plastic, polyethylene, polystyrene, wood, and/or metal (e.g., brass, aluminum, and/or titanium). For example, in some embodiments, venue storage apparatus 200 may be a formed from molded fiber and/or recycled materials. In some embodiments, venue storage apparatus 200 may be formed from polymers or plastics that allow venue storage apparatus 200 to be cleaned and/or reused. In an embodiment, venue storage apparatus 200 may also be decorated and/or etched with designs specific to the events and/or preferences of the patron (e.g., favorite sports team or advertising).

Figure 15:
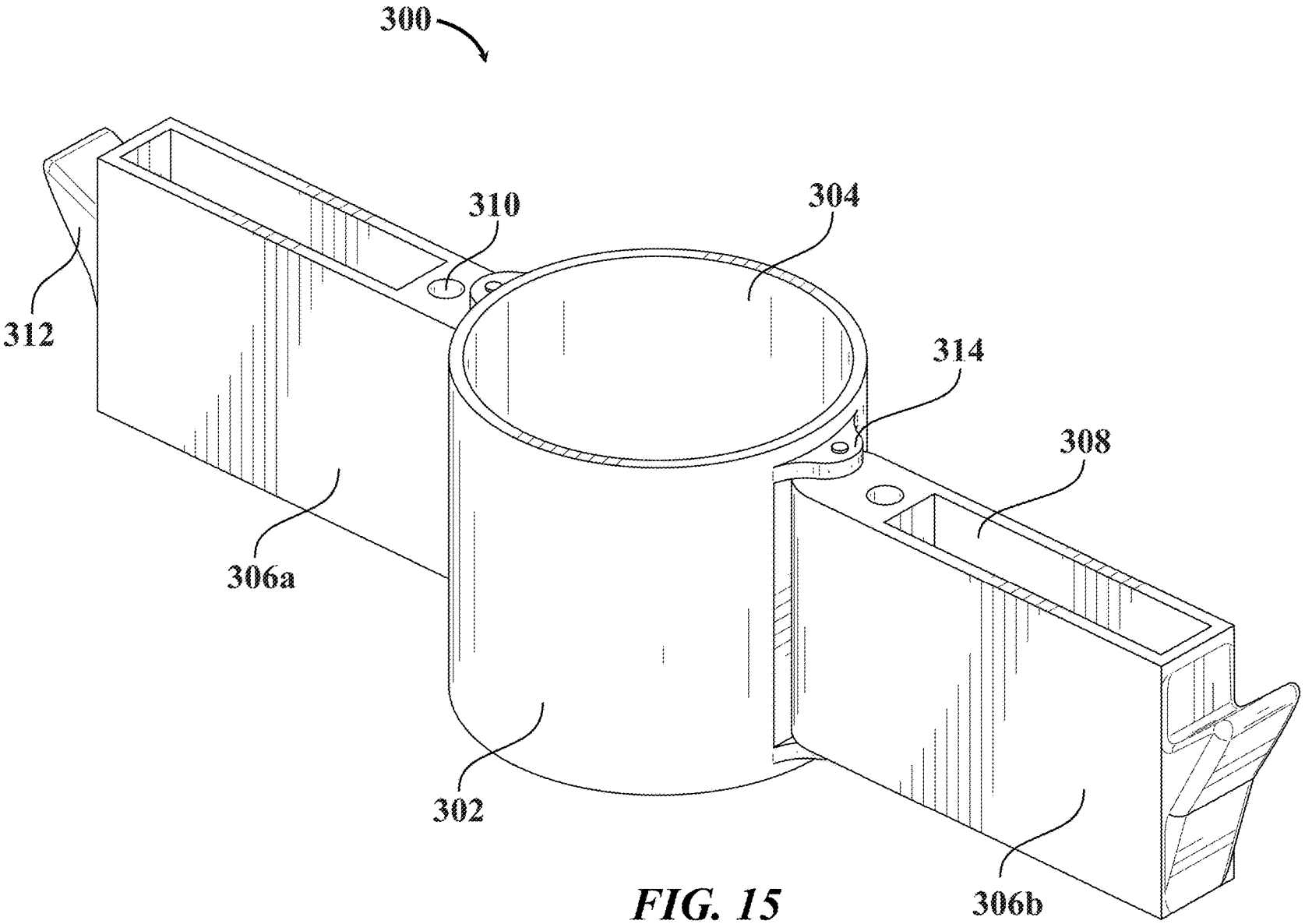
FIG. 15 is a front-perspective view of a third exemplary embodiment of a venue storage apparatus, according to an embodiment of the present disclosure.
Figure 16:
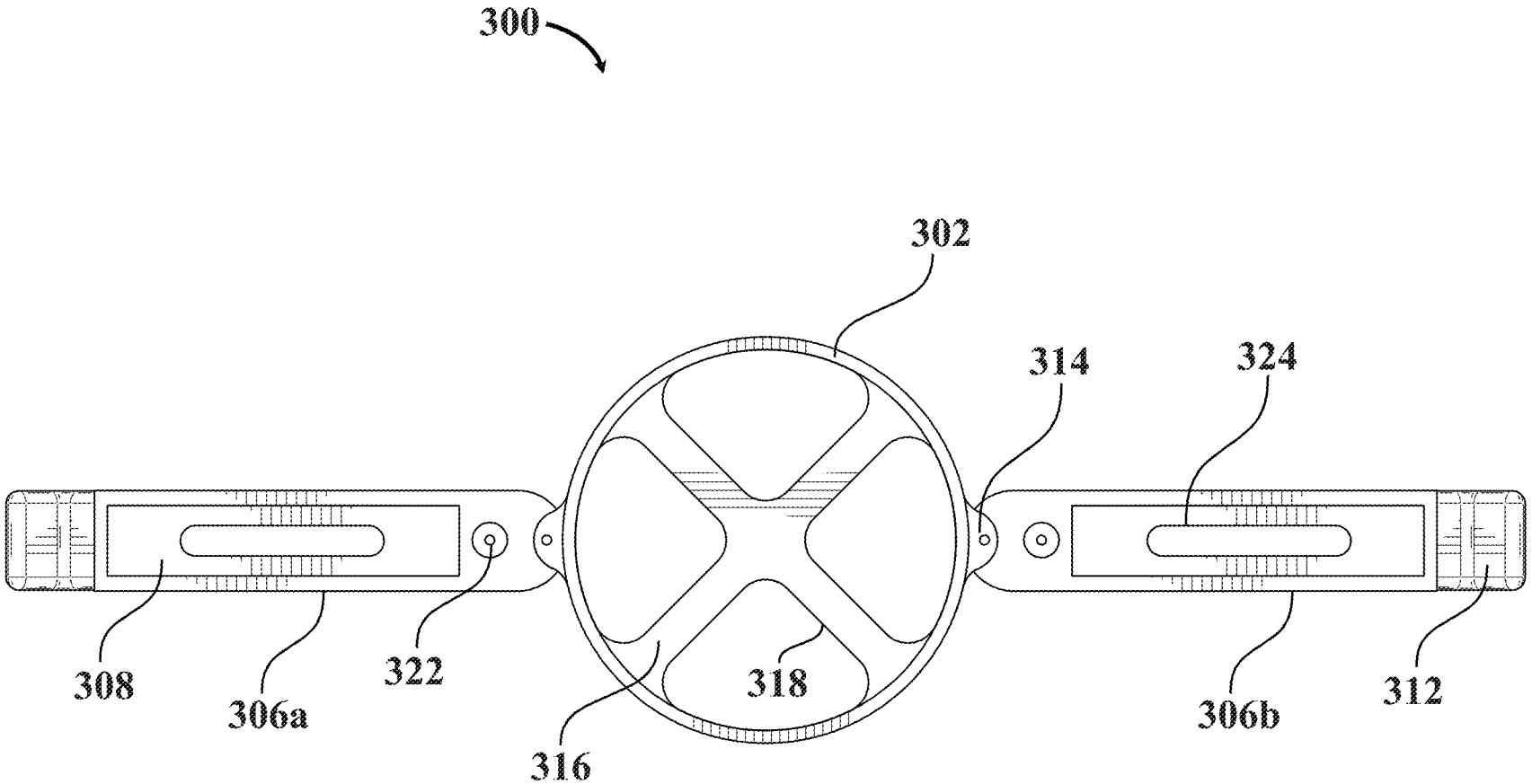
FIG. 16 is a top-planar view of the third exemplary embodiment of the venue storage apparatus of FIG. 15, according to an embodiment of the present disclosure.

Finally, referring now to FIGS. 15-21, a third exemplary embodiment of the venue storage apparatus in accordance with the subject invention is generally indicated as 300. As such, as shown in FIG. 15, in conjunction with FIGS. 16-21, in this embodiment, venue storage apparatus 300 may include a housing 302 configured to be removably coupled to at least one portion of a seatback 330 of a venue seat 328. In this manner, housing 302 may comprise a drink receptacle 304 configured to retain at least one portion of a drink 332 within at least one portion of drink receptacle 304. In this manner, drink receptacle 304 may be generally cylindrical. Moreover, as shown in FIG. 16, the sidewall of housing 302 may be generally cylindrical, such that a central axis is in a center of the sidewall of housing 302 extending into and perpendicular to a planar field. In addition, a top edge of the sidewall of housing 302 may be beveled to facilitate entry of the drink 332 into drink receptacle 304. Additionally, in some embodiments, housing 302 of venue storage apparatus 300 may be permanently affixed and/or coupled to at least one portion of a seatback 330 (i.e., back of seat) of a venue seat 328. In this manner, in these other embodiments, venue storage apparatus 300 may be integrated with least one portion of a seatback 330 (i.e., back of seat) of a venue seat 328, such that a manufacturer may produce venue seat 328 comprising venue storage apparatus 300 seamlessly.

Figure 17:
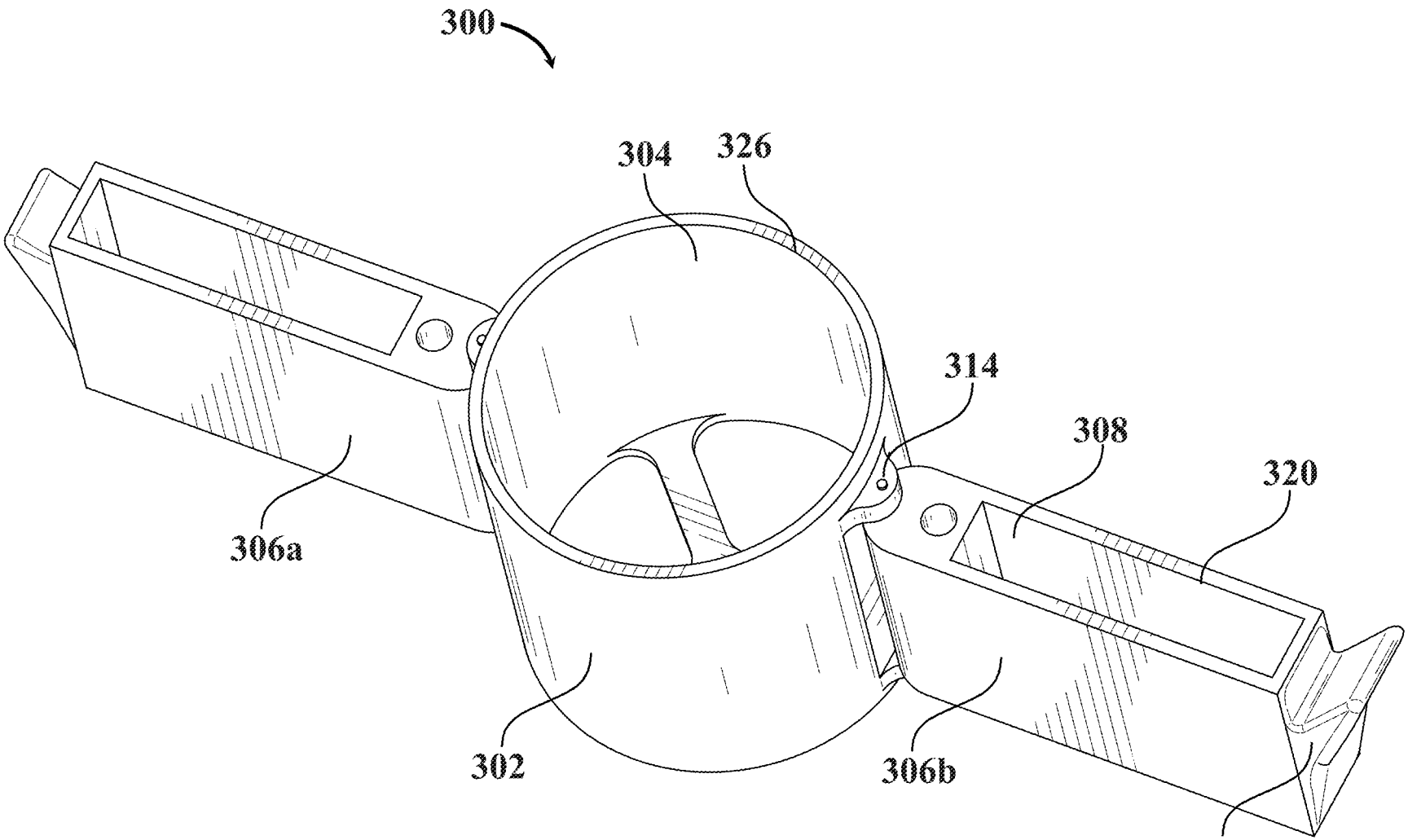
FIG. 17 is a top-perspective view of the third exemplary embodiment of the venue storage apparatus of FIG. 15, according to an embodiment of the present disclosure.
Figure 21:
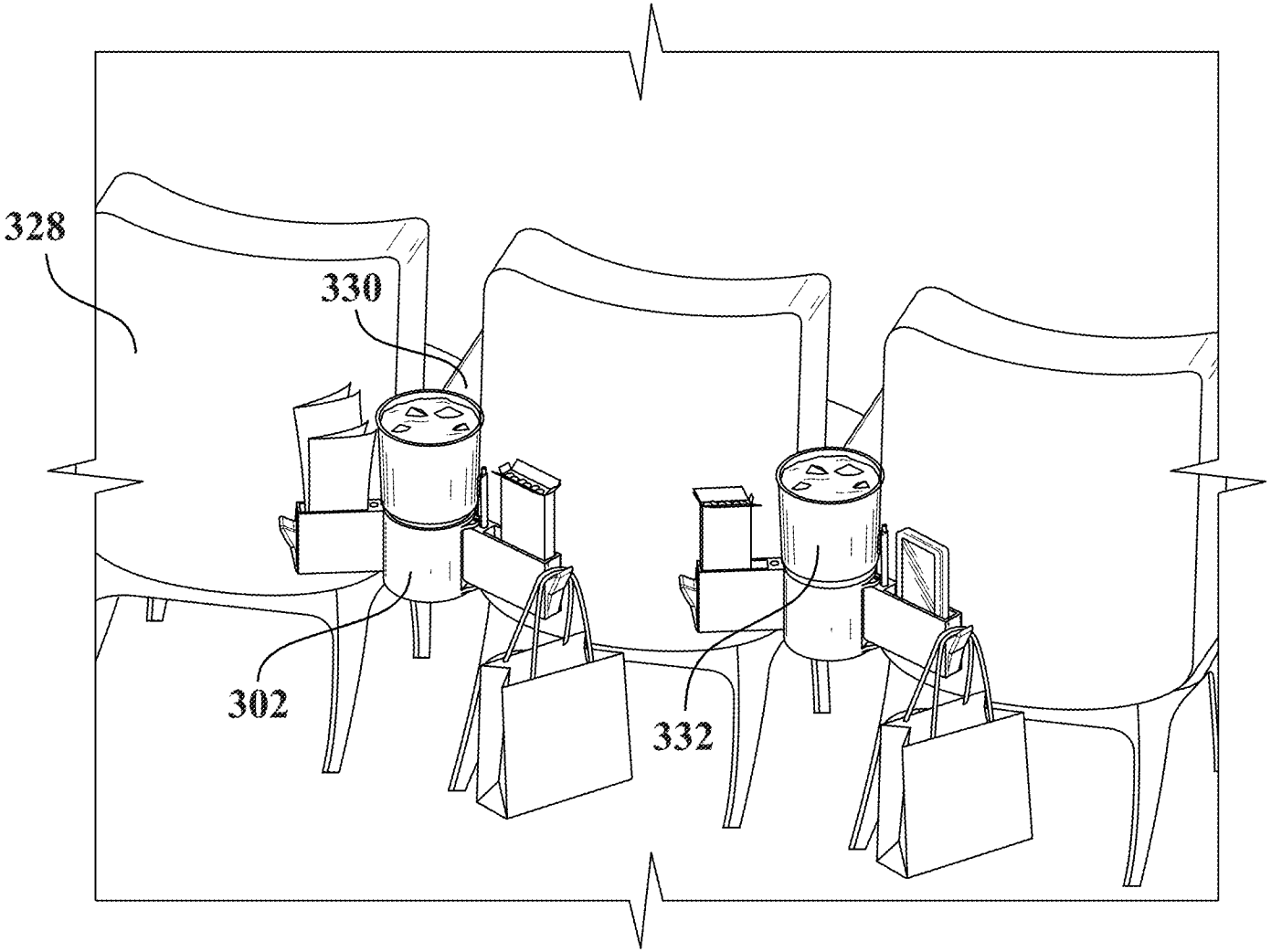
FIG. 21 is a perspective view of the third exemplary embodiment of the venue storage apparatus of FIG. 15 removably coupled to a venue seat, in which a drink, foodstuffs, mobile computing devices, writing utensils, and/or merchandise are disposed about the venue storage apparatus of FIG. 15, according to an embodiment of the present disclosure, according to an embodiment of the present disclosure.

As shown in FIG. 16 and FIG. 17, in conjunction with FIG. 21, drink receptacle 304 may include a bottom wall 316 having a plurality of openings 318. In this manner, the plurality of openings 318 may be configured to allow any fluid (e.g., soda leaking from a cup) released from drink 332 and/or any residuals from any weather phenomena known in the art (e.g., rain, snow, hail, sleet, debris) to be extruded (e.g., via gravity) and/or drained from drink receptacle 304, such that drink receptacle 304 may remain clear, allowing for re-use without requiring additional clearing and/or cleaning. Additionally, in this embodiment, the plurality of openings 318 may be disposed about bottom wall 316 of drink receptacle 304, such that bottom wall 316 may be in the shape of an "X". As such, in some embodiments, bottom wall 316 may conform to any shape and/or pattern known in the art, such that bottom wall 316 may provide adequate support to retain and hold a plurality of drinks 332 throughout a predetermined period of time (e.g., at least 20 years) without requiring maintenance and/or replacement.

Figure 18:
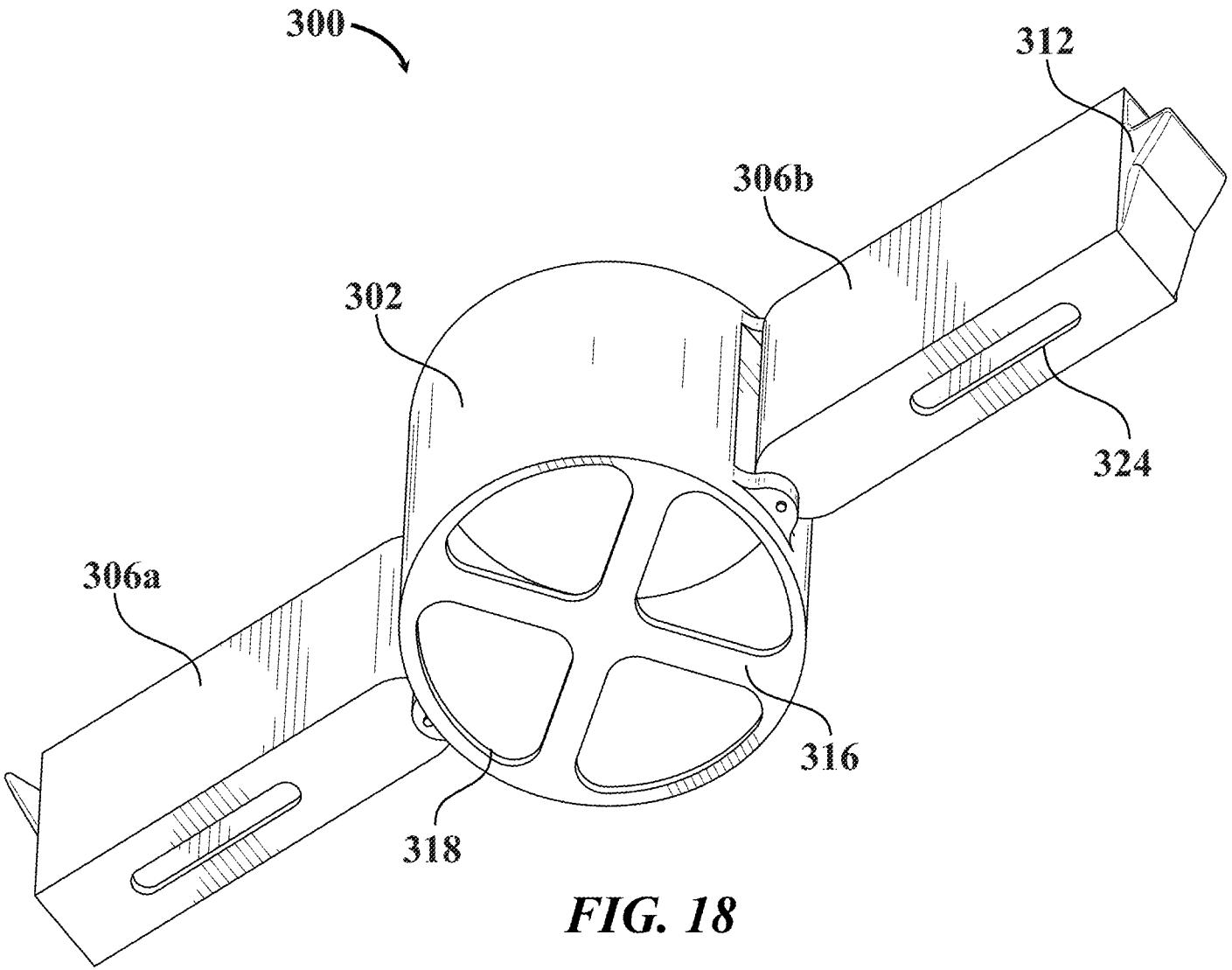
FIG. 18 is a bottom-perspective view of the third exemplary embodiment of the venue storage apparatus of FIG. 15 comprising a display device, according to an embodiment of the present disclosure.

In addition, as shown in FIG. 17 and FIG. 18, in conjunction with FIGS. 15-16 and FIGS. 19-21, in an embodiment, venue storage apparatus 300 may further comprise at least two hinges 314, such that at least two appendages 306*a*, 306*b* may be rotationally affixed to the at least two hinges 314. In this manner, subsequent to receiving a manually applicable directional pressure, the at least two appendages 306*a*, 306*b* may be configured to freely rotate about a range of motion comprising about 0° to about 180° to the central axis of the sidewall of drink receptacle 304. As such, the at least two appendages 306*a*, 306*b* may be configured to extend outwardly from housing 302 at an angle of about 0° to about 180° to the central axis of the sidewall of drink receptacle 304. Moreover, in this embodiment, the at least two hinges 314 may comprise at least one locking pin having at least one detent and/or spring (not shown), such that when a patron positions the at least two appendages 306*a*, 306*b* at a desired angle to the central axis of the sidewall of drink receptacle 304, the locking pin may be engaged immobilizing the at least two appendages 306*a*, 306*b* at that angle. For example, in some embodiments, when the at least two appendages 306*a*, 306*b* are disposed about at least one patron and/or venue selected angle (e.g., a 45° angle) to the central axis of the sidewall of drink receptacle 304, the locking pin, detents and/or springs may be engaged, such that the at least two appendages are immobilized at the at least one patron and/or venue selected angle. Accordingly, in these other embodiments, when the locking pin is disengaged, the at least two appendages may then freely rotate about 0° to about 180° to the central axis of the sidewall of drink receptacle 304 until a new desired angle may be achieved by the patron and/or established by the venue. Furthermore, in some embodiments, venue storage apparatus 300 may only comprise one of the at least two appendages 306*a*, 306*b*, such that venue storage apparatus may be disposed at the end of a row of venue seats 328 (e.g., venue seat 328 disposed next to a set of stairs of an entertainment venue).

In an embodiment, at least one portion of the at least two appendages 306*a*, 306*b* may also be affixed to housing 302, via an outer surface of the sidewall of drink receptacle 304. Moreover, the at least two appendages 306*a*, 306*b* may comprise a plurality of receptacles 308, 310 (hereinafter "first receptacle 308" and/or "second receptacle 310"). In this manner, first receptacle 308 may comprise a sidewall 320 generally in a rectangular shape and/or second receptacle 310 may comprise a sidewall that is generally in a cylindrical shape. Moreover, in some embodiments, a top edge of sidewall 320 of first receptacle 308 and/or a top edge of the sidewall of second receptacle 310 may be beveled to facilitate entry of the foodstuffs and/or merchandise into first receptacle 308 and/or second receptacle 310.

In this embodiment, as shown in FIG. 17 and FIG. 18, in conjunction with FIGS. 15-16 and FIGS. 19-21, first receptacle 308 may comprise at least one opening 324 disposed about at least one portion of a bottom wall of first receptacle 308. In the same manner, as disclosed above, the at least one opening 324 may be configured to allow any portion of merchandise and/or foodstuffs released from a container (not shown) (e.g., candy accidently falling out of a candy box) and/or any weather phenomena known in the art (e.g., rain, snow, hail, sleet, debris) to be extruded (e.g., via gravity) and/or drain from first receptacle 308 may remain clear, allowing for re-use without requiring additional clearing and/or cleaning. Moreover, in this embodiment, first receptacle 308 may be molded, such that first receptacle 308 may be configured to receive a plurality of merchandise (e.g., a mobile device and/or a pamphlet), such that the patron may dispose them within the venue storage apparatus, allowing their hands to be free during the event.

Moreover, as shown in FIG. 17 and FIG. 18, in conjunction with FIGS. 15-16 and FIGS. 19-21, in this embodiment, second receptacle 310 may comprise at least one opening 322 disposed about at least one portion of a bottom wall of second receptacle 310. The at least one opening 322 may be configured to allow any portion of merchandise and/or foodstuffs released from a container (not shown) (e.g., ink escaping and/or leaking from a pen) and/or any weather phenomena known in the art (e.g., rain, snow, hail, sleet, debris) to be extruded (e.g., via gravity) and/or drain from second receptacle 310, such that second receptacle 310 may remain clear, allowing for re-use without requiring additional clearing and/or cleaning. Moreover, in this embodiment, second receptacle 310 may be molded, such that second receptacle 310 may be configured to receive a plurality of merchandise (e.g., a pen, a pencil, a mobile computing device stylus, and/or a straw for drink 332), such that the patron may dispose them within the venue storage apparatus, allowing their hands to be free during the event.

In an embodiment, bottom wall 316 of drink receptacle 304 may comprise a width that is less than a distance (i.e., a diameter) of an opening 326 of drink receptacle 304, such that drink receptacle 304 may support smaller drinks, cans, bottles, and/or a combination of thereof. Additionally, in this embodiment, drink receptacle 304 may include at least one tab (not shown) disposed about at least a portion of an interior surface of the sidewall of drink receptacle 304, such that smaller cups and/or smaller bottles may be prevented from falling through bottom wall 316 of drink receptacle 304. In this manner, in this embodiment, the at least one tab may be flexible enough to be pressed flat on the interior surface of the sidewall of drink receptacle 304, allowing standard-sized cups and/or larger-sized cups to be inserted in drink receptacle 304.

As such, in an embodiment, a bottom wall of first receptacle 308 and/or second receptacle 310 may also comprise a width that is less than a distance (i.e., a width and/or a diameter) of an opening of first receptacle 308 and/or second receptacle 310, such that first receptacle 308 and/or second receptacle 310 may support smaller foodstuffs and/or merchandise. Additionally, in this embodiment, first receptacle 308 and/or second receptacle 310 may include at least one tab (not shown) disposed about at least a portion of an interior surface of sidewall 320 of first receptacle 308 and/or the sidewall of second receptacle 310, such that smaller foodstuffs and/or merchandise may be prevented from falling through the bottom wall of first receptacle 308 and/or second receptacle 310. In this manner, in this embodiment, the at least one tab may be flexible enough to be pressed flat on the interior surface of the sidewall of first receptacle 308 and/or second receptacle 310, allowing standard sized foodstuffs and/or merchandise and/or larger sized foodstuffs and/or merchandise to be inserted in first receptacle 308 and/or second receptacle 210.

As shown in FIGS. 15-21, in an embodiment, the at least two appendages 306*a*, 306*b* may further include a hooking mechanism 312. As such, hooking mechanism 312 may be disposed about at least one portion of an outer surface of the at least two appendages 306*a*, 306*b* (e.g., hooking mechanism 312 being disposed about an end wall of the at least two appendages 306*a*, 306*b*). In this manner, hooking mechanism 312 may be configured to jut from the at least one portion of the outer surface of the at least two appendages 306*a*, 306*b* at an angle comprising a range of at least 5° to at most 85°. For example, in some embodiments, hooking mechanism 312 may jut at an angle of about 45° with respect to the at least two appendages 306*a*, 306*b*.

Figure 19:
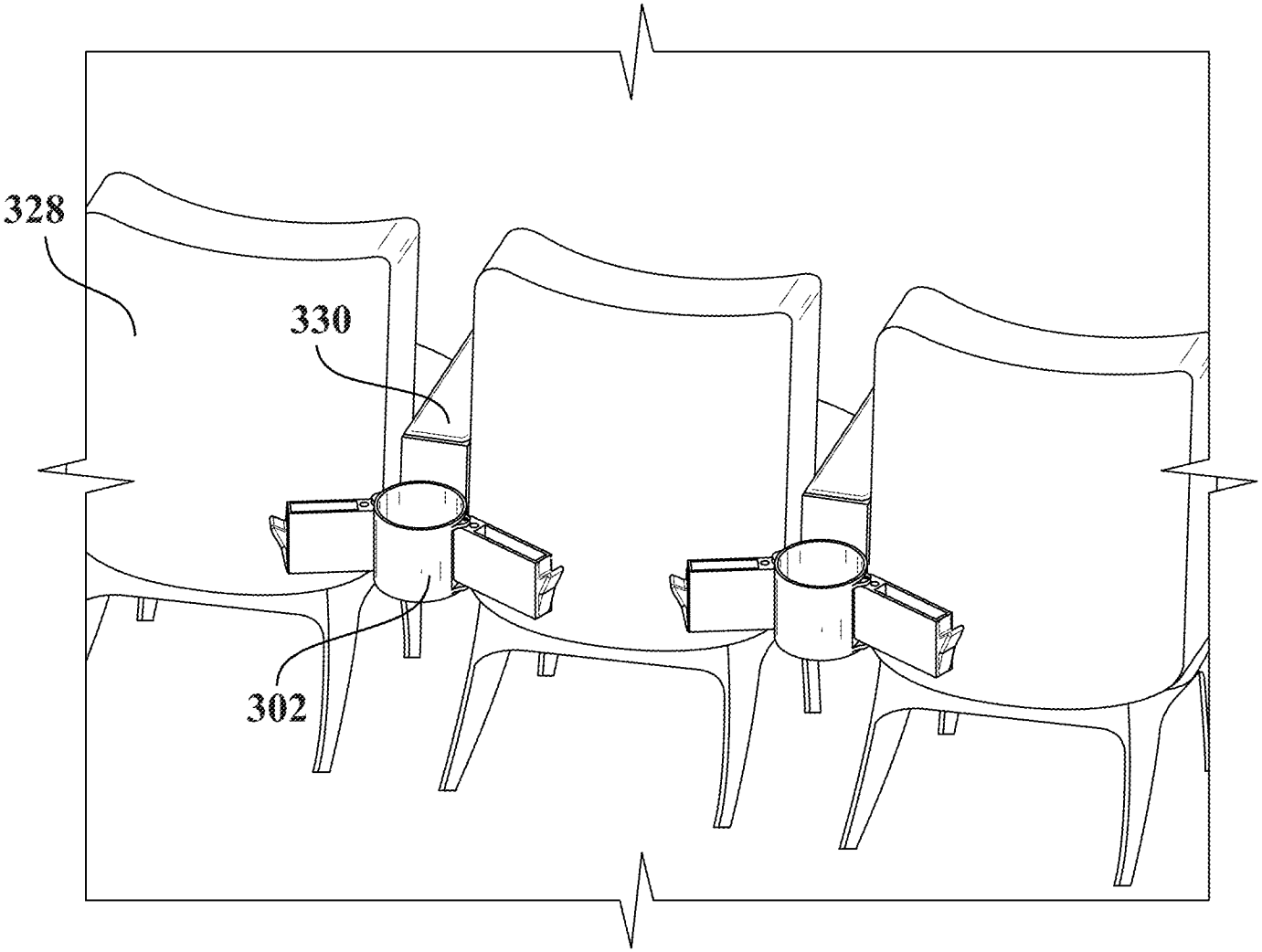
FIG. 19 is a perspective view of the third exemplary embodiment of the venue storage apparatus of FIG. 15 removably coupled to a venue seat, according to an embodiment of the present disclosure.

In this embodiment, as disclosed above, as shown in FIGS. 15-21 hooking mechanism 312 may be configured to retain and/or hold merchandise of a patron, including but not limited to sacks, bags, handbags, purses, and/or hangers, such that the patron may be hands-free during the event. In this manner, hooking mechanism 312 may be molded from a material comprises a high level of strength, such that the merchandise may not damage hooking mechanism 312 and/or that hooking mechanism 312 may not shear, tear, and/or break away from the at least two appendages 306*a*, 306*b* (e.g., a high-strength polyethylene, metal, plant materials, food-grade plastics, high-grade plastic, and/or durable plastic). Furthermore, hooking mechanism 312 may be configured to retain a plurality of merchandise of the patron (e.g., a sack, a bag, and a jersey) simultaneously. Accordingly, in this embodiment, hooking mechanism 312 may be configured to securely fasten the merchandise to venue storage apparatus 300, via a friction fit (e.g., gravity), such that the merchandise may not translate and/or release from hooking mechanism 312 during the duration of the event at the venue. Furthermore, as shown in FIG. 19, hooking mechanism 312 may be disposed such that hooking mechanism 312 may be positioned away from the venue seat and/or the patron, such that the patron is not at risk of injury by hooking mechanism 312. In addition, an edge of hooking mechanism 312 may be beveled and/or rounded to facilitate entry of the merchandise onto hooking mechanism 312.

As shown in FIG. 19 and FIG. 21, in conjunction with FIGS. 15-18, in an embodiment, housing 302 of venue storage apparatus 300 may be configured to be removably affixed coupled to at least one portion of a seatback 330 of venue seat 328. In this manner, housing 302 may be configured to selectively couple to the at least one portion of the at least one portion of a seatback 330 of venue seat 328, via a coupling mechanism, enabling venue storage apparatus 300 to align with the at least one portion of a seatback 330 of venue seat 328, such that a patron may easily access any drink 332, merchandise, and/or foodstuffs retained by venue storage apparatus 300. As such, in some embodiments, housing 302 of venue storage apparatus 300 may further comprise at least one aperture (not shown) disposed therethrough about at least one portion of the sidewall of housing 302, such that venue storage apparatus 300 may be removably affixed to the at least one portion of a seatback 330 of venue seat 324.

In an embodiment, as disclosed above, housing 302 may also comprise a locking member having at least one detent and/or spring (not shown) disposed within housing 302 and/or drink receptacle 304. As such, the locking member may comprise an engaged position, in which locking member immobilizes housing 302 relative to the at least one portion of a seatback 330 of venue seat 328. The locking member may also comprise a disengaged position, in which the locking member may be configured to release the coupling mechanism from the at least one portion of a seatback 330 of venue seat 328, such that housing 302 of venue storage apparatus 300 may be removed from the at least one portion of a seatback 330 of venue seat 328. In this embodiment, the act of coupling housing 302 of venue storage apparatus 300, via the coupling mechanism, to the at least one portion of a seatback 330 of venue seat 328 may transition the locking member into the engaged position (e.g., a tab preventing the release of the coupling mechanism, a clip and/or switch engaging at least one alternative portion of the at least one portion of a seatback 330 of venue seat 328, and/or a magnetic engagement between the at least one alternative portion of the at least one armrest and/or the locking member), immobilizing housing 302 to the at least one portion of a seatback 330 of venue seat 328. In this manner, when the coupling mechanism is released, the locking member may be disengaged, releasing housing 302 of venue storage apparatus 300 from the at least one portion of a seatback 330 of venue seat 328.

Figure 20:
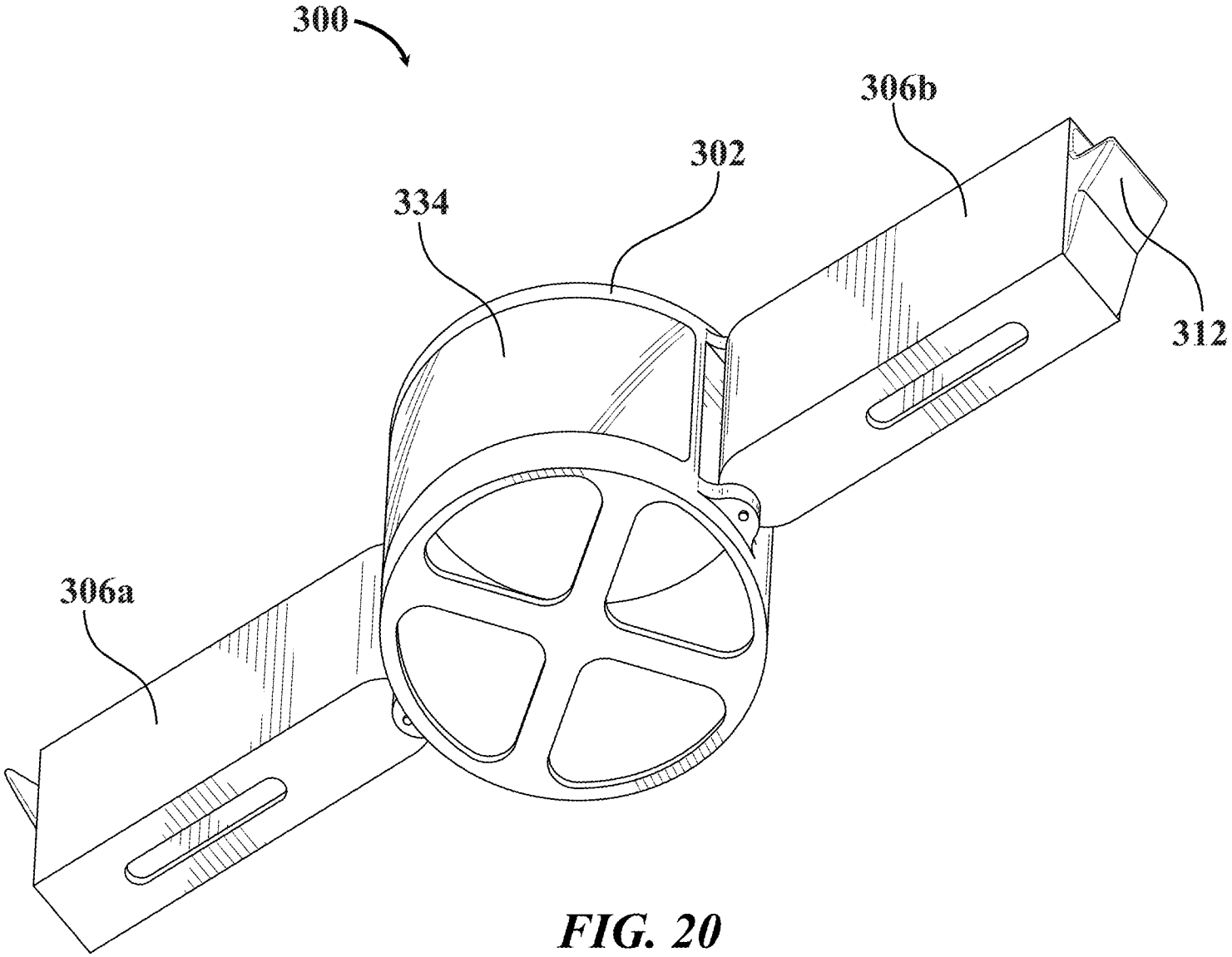
FIG. 20 is a bottom-perspective view of the third exemplary embodiment of the venue storage apparatus of FIG. 15 comprising a display device, according to an embodiment of the present disclosure.

Furthermore, as shown in FIG. 20, in conjunction with FIGS. 15-19, in an embodiment, venue storage apparatus 300 may include at least one processor and/or at least one PCB disposed within at least one portion of housing 302. As such, in this embodiment, venue storage apparatus 300 may comprise a display device 334 disposed upon and/or within at least one portion of the outer surface of housing 302 and/or at least one portion of the outer surface of at least one of the at least two appendages 306*a*, 306*b* of venue storage apparatus 300 (e.g., display device 334 is seamless and/or flush with the outer surface of housing 302 and/or the outer surface of at least one of the at least two appendages 306*a*, 306*b*), display device 334 being communicatively coupled to the at least one processor and/or the PCB. Accordingly, the at least one processor and/or the at least one PCB may be communicatively coupled to a Wi-Fi and/or Bluetooth access point, in order to allow communication between a computing device and/or a mobile computing device and display device 334. As such, the computing device and/or mobile computing device may be configured to transmit a signal to the at least one processor and/or the at least one PCB, such that the at least one processor, via the at least one PCB, may be configured to transmit a signal to display device 334 to display and/or present information in visual form (e.g., a set of images and/or a video).

Accordingly, in this embodiment, display device 334 of venue storage apparatus 300 may be configured to display specific information and/or advertisements pertaining to events at the venue and/or theater and/or any third-party advertisements related to the event. Additionally, display device 334 may be configured to display designs specific venue-related material (e.g., score of the game, statistics of sports players, theater program, seating number, sports team logo, and/or venue/theater logo). In some embodiments, display device 334 may be configured to output a light, such that when a lighting system at a venue and/or theater has been diminished for the event, the patron may easily find their seat and/or walk through a seating isle at the venue and/or theater.

In this embodiment, as disclosed above, display device 334 may be output device known in the art configured to present information in visual and/or tactile form. Non-limiting examples of display device 334 may include an LED screen, a LCD screen, an OLED screen, and/or a plasma screen. For ease of reference, the exemplary embodiment disclosed herein refers to an LED screen and/or an OLED screen, but this description should not be interpreted as exclusionary of other output devices. In this embodiment, display device 334 may comprise a protective screen, such that display device 334 may be protected from day-to-day wear (e.g., scratches, broken pixels, etc.).

Additionally, in an embodiment, venue storage apparatus 300 and any of its component parts may be formed from a variety of materials. Non-limiting examples of the materials may include plant materials, food-grade plastics, pressed molded fiber, disposable plastic, durable plastic, polyethylene, polystyrene, wood, and/or metal (e.g., brass, aluminum, and/or titanium). For example, in some embodiments, venue storage apparatus 300 may be a formed from molded fiber and/or recycled materials. In some embodiments, venue storage apparatus 300 may be formed from polymers or plastics that allow venue storage apparatus 300 to be cleaned and/or reused. In an embodiment, venue storage apparatus 300 may also be decorated and/or etched with designs specific to the events and/or preferences of the patron (e.g., favorite sports team or advertising).

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

INCORPORATION BY REFERENCE

Bergin, Peter W. A., et al. "SUPERMARKET CART CUP AND ACCESSORY HOLDER". U.S. Pat. No. 6,186,382 B1, United States Patent and Trademark Office, 13 Feb. 2001.

Jacobs, Matthew D., et al. "POWERED CHAIRS FOR PUBLIC VENUES, ASSEMBLIES FOR USE IN POWERED CHAIRS, AND COMPONENTS FOR USE IN ASSEMBLIES FOR USE IN POWERED CHAIRS". U.S. Pat. No. 9,730,518 B1, United States Patent and Trademark Office, 15 Aug. 2017.

Seidl, Ken. "LIGHTED CUP HOLDER FOR SEATING ARRANGEMENTS". U.S. Pat. No. 11,357,119 B1, United States Patent and Trademark Office, 7 Jun. 2022.

All publications, patents, and patent applications mentioned in this specification are herein incorporated by reference to the same extent as if each individual publication, patent, or patent application was specifically and individually indicated to be incorporated by reference. To the extent publications and patents or patent applications incorporated by reference contradict the disclosure contained in the specification, the specification is intended to supersede and/or take precedence over any such contradictory material.

It is also to be understood that the following claims are intended to cover all of the generic and specific features of the invention herein described, and all statements of the scope of the invention which, as a matter of language, might be said to fall therebetween.

What is claimed is:

1. An optimized venue storage apparatus configured to be coupled to at least one portion of an armrest and a seatback relative to a venue seat, the apparatus comprising:

a housing having a drink receptacle, the drink receptacle including a cylindrical sidewall having a vertically extending central axis, wherein the housing is configured to be mounted to at least one portion of the armrest, the seatback, or both of the venue seat;

at least two appendages, each of the at least two appendages comprising at least two receptacles, each of the at least two receptacles having a front wall, a sidewall, an end wall, a bottom wall, and a top end, the at least two appendages extending outwardly from the housing at an angle of at most about 90° to the central axis of the sidewall of the drink receptacle;

at least one hooking mechanism disposed about at least one portion of an outer surface of the end wall of each of the at least two appendages, whereby the at least one hooking mechanism is configured to temporarily affix merchandise to the outer surface of the sidewall of each of the at least two appendages; and wherein at least one portion of each of the at least two appendages is affixed to at least one portion of an outer surface of the sidewall of the housing.

2. The apparatus of claim 1, wherein the drink receptacle has a plurality of openings disposed about at least a portion of the bottom surface of the drink receptacle.

3. The apparatus of claim 2, wherein the top surface of the sidewall of the drink receptacle is beveled to facilitate entry of the drink into the drink receptacle.

4. The apparatus of claim 1, wherein the at least two receptacles of the at least two appendages are configured to retain foodstuffs, merchandise, or both.

5. The apparatus of claim 4, wherein the top end of the at least one receptacle of the at least two appendages is beveled to facilitate entry of the foodstuffs, merchandise, or both into the at least one receptacle.

6. The apparatus of claim 4, wherein the foodstuffs, merchandise, or both are selected from a group consisting of food, candy, mobile devices, pens, pencils, markers, apparel, magazines, pamphlets, and a combination of thereof.

7. The apparatus of claim 1, wherein at least one portion of the sidewall of each of the at least two appendages, at least one portion of the sidewall of the housing, or both comprise a display device communicatively coupled to at least one external computing device, whereby the display device is configured to present a plurality of advertisements, venue-related material, or both.

8. The apparatus of claim 1, wherein at least one portion of the sidewall of the housing, at least one portion of the sidewall of each of the at least two appendages, or both is configured to couple to at least one portion of the armrest or the seatback relative to the venue seat by a coupling mechanism selected from a group consisting of a screw-threaded engagement, a magnetic engagement, a bias pin, a friction fit, and a combination of thereof.

9. The apparatus of claim 8, wherein the housing, each of the at least two appendages, or both further comprises a locking member, the locking member having an engaged position in which the locking member selectively immobilizes the housing, each of the at least two appendages, or both relative to at least one portion of the armrest or the seatback relative to the venue seat, a disengaged position in which the housing, each of the at least two appendages, or both is removable from the at least one portion of the armrest or the seatback relative to the venue seat, or both.

10. The apparatus of claim 1, wherein subsequent to receiving a manually applicable directional pressure, at least one of the at least two appendages rotationally translates about a 180° range of motion to the central axis of the cylindrical sidewall of the drink receptacle.

11. An optimized venue storage apparatus configured to be coupled to at least one portion of an armrest and a seatback relative to a venue seat, the apparatus comprising:

a housing having a drink receptacle, the drink receptacle including a cylindrical sidewall having a vertically extending central axis, wherein the housing is configured to be mounted to at least one portion of the armrest, the seatback, or both of the venue seat;

at least two appendages, each of the at least two appendages comprising at least two receptacles, each of the at least two receptacles having a front wall, a sidewall, an end wall, a bottom wall, and a top end, the at least two appendages extending outwardly from the housing at an angle of at most about 90° to the central axis of the sidewall of the drink receptacle;

a locking member disposed about at least one portion of the sidewall of the housing, at least one portion of the sidewall of each of the at least two appendages, or both, the locking member having an engaged position in which the locking member selectively immobilizes the housing, each of the at least two appendages, or both relative to the at least one portion of the venue seat, a disengaged position in which the housing, each of the at least two appendages, or both is removable from the at least one portion of the venue seat, or both;

at least one hooking mechanism disposed about at least one portion of an outer surface of the end wall of each of the at least two appendages, whereby the at least one hooking mechanism is configured to temporarily affix merchandise to the outer surface of the sidewall of each of the at least two appendages; and wherein at least one portion of each of the at least two appendages is affixed to at least one portion of an outer surface of the sidewall of the housing.

12. The apparatus of claim 11, wherein the drink receptacle has a plurality of openings disposed about at least a portion of a bottom surface of the drink receptacle, the sidewall of the drink receptacle, or both.

13. The apparatus of claim 12, wherein the top surface of the sidewall of the drink receptacle is beveled to facilitate entry of the drink into the drink receptacle.

14. The apparatus of claim 13, wherein at least one portion of the sidewall of the housing, at least one portion of the sidewall of each of the at least two appendages, or both is configured to couple to at least one portion of the armrest or the seatback relative to the venue seat by a coupling mechanism selected from a group consisting of a screw-threaded engagement, a magnetic engagement, a bias pin, a friction fit, and a combination of thereof.

15. The apparatus of claim 14, wherein at least one portion of the sidewall of each of the at least two appendages, at least one portion of the sidewall of the housing, or both comprises a display device communicatively coupled to at least one external computing device, whereby the display device is configured to present a plurality of advertisements, venue-related material, or both.

16. The apparatus of claim 15, wherein subsequent to receiving a manually applicable directional pressure, at least one of the at least two appendages rotationally translates about a 180° range of motion to the central axis of the cylindrical sidewall of the drink receptacle.

17. A method for mounting storage onto at least one portion of an armrest and a seatback relative to a venue seat, the method comprising:

providing an optimized venue storage apparatus, the optimized storage apparatus comprising:

a housing having a drink receptacle, the drink receptacle including a cylindrical sidewall having a vertically extending central axis, wherein the housing is configured to be mounted to at least one portion of the armrest, the seatback, or both of the venue seat;

at least two appendages, each of the at least two appendages comprising at least two receptacles, each of the at least two receptacles having a front wall, a sidewall, an end wall, a bottom wall, and a top end, the at least two appendages extending outwardly from the housing at an angle of at most about 90° to the central axis of the sidewall of the drink receptacle; and at least one hooking mechanism disposed about at least one portion of an outer surface of the end wall of each of the at least two appendages, whereby the at least one hooking mechanism is configured to temporarily affix merchandise to the outer surface of the sidewall of each of the at least two appendages;

selectively affixing, via a coupling mechanism, at least one portion of the sidewall of the housing, at least one portion of the sidewall of each of the at least two appendages, or both to at least one portion of the armrest or the seatback relative to the venue seat; and wherein at least one portion of each of the at least two appendages is affixed to at least one portion of an outer surface of the sidewall of the housing.

18. The method of claim 17, wherein the optimized venue storage apparatus further comprises a locking member, the locking member having an engaged position in which the locking member immobilizes the housing, each of the at least two appendages, or both relative to at least one portion of the armrest or the seatback relative to the venue seat, and a disengaged position in which the housing, each of the at least two appendages, or both is removable from the at least one portion of the armrest or the seatback relative to the venue seat, or both.

* * * * *